US010191445B2

(12) United States Patent
Zensai et al.

(10) Patent No.: US 10,191,445 B2
(45) Date of Patent: Jan. 29, 2019

(54) IMAGE FORMING APPARATUS

(71) Applicant: CANON KABUSHIKI KAISHA, Tokyo (JP)

(72) Inventors: Shoichi Zensai, Mishima (JP); Tomofumi Kawamura, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/891,597

(22) Filed: Feb. 8, 2018

(65) Prior Publication Data

US 2018/0164739 A1 Jun. 14, 2018

Related U.S. Application Data

(62) Division of application No. 15/451,532, filed on Mar. 7, 2017, now Pat. No. 9,927,764.

(30) Foreign Application Priority Data

Mar. 11, 2016 (JP) ..... 2016-048367

(51) Int. Cl.

| | |
|---|---|
| ***G03G 21/16*** | (2006.01) |
| ***G03G 21/18*** | (2006.01) |
| ***G03G 15/08*** | (2006.01) |

(52) U.S. Cl.

CPC ..... *G03G 21/1647* (2013.01); *G03G 15/0865* (2013.01); *G03G 21/1633* (2013.01); (Continued)

(58) Field of Classification Search

CPC ..... G03G 21/1647; G03G 21/1633; G03G 21/1842; G03G 21/1825; G03G 21/1676; G03G 21/1821; G03G 15/0865

See application file for complete search history.

(56) References Cited

U.S. PATENT DOCUMENTS

| | | | |
|---|---|---|---|
| 6,795,671 | B2 | 9/2004 | Matsuoka |
| 7,881,634 | B2 | 2/2011 | Zensai |

(Continued)

FOREIGN PATENT DOCUMENTS

| | | | |
|---|---|---|---|
| JP | 2012-063391 | A | 3/2012 |
| JP | 2013-195541 | A | 9/2013 |
| JP | 2014-067005 | A | 4/2014 |

*Primary Examiner* — G. M. A Hyder
(74) *Attorney, Agent, or Firm* — Venable LLP

(57) ABSTRACT

An image forming apparatus includes a movable unit including a regulating portion for regulating a position of a developing unit for supporting a developer carrying member, a driving member for moving the movable unit from a contact position to a spaced position, and an openable member for opening and closing an opening provided for demounting the developer carrying member and/or the image bearing member from a main assembly of the image forming apparatus. A pressing member presses and moves the movable unit by being moved in interrelation with an opening operation of the openable member. When the driving member is displaced from a contact phase to a spaced phase, the movable unit is moved to a first spaced position, and when the openable member is opened, the pressing member presses and moves the movable unit to a second spaced position from the contact position.

11 Claims, 19 Drawing Sheets

(52) U.S. Cl.
CPC ..... *G03G 21/1676* (2013.01); *G03G 21/1821* (2013.01); *G03G 21/1825* (2013.01); *G03G 21/1842* (2013.01)

(56) References Cited

U.S. PATENT DOCUMENTS

| | | | | |
|---|---|---|---|---|
| 8,837,982 | B2 | 9/2014 | Matsuda | |
| 9,429,906 | B2 | 8/2016 | Yoshimura et al. | |
| 2005/0053394 | A1* | 3/2005 | Ishii | G03G 21/1821 399/111 |
| 2007/0071495 | A1 | 3/2007 | Hashimoto et al. | |
| 2007/0147887 | A1* | 6/2007 | Hattori | G03G 21/1623 399/119 |
| 2007/0160388 | A1* | 7/2007 | Yoshimura | G03G 21/1825 399/111 |
| 2010/0202797 | A1* | 8/2010 | Kikuchi | G03G 21/1623 399/111 |
| 2014/0348540 | A1 | 11/2014 | Matsuda | |
| 2015/0227110 | A1 | 8/2015 | Yoshimura et al. | |
| 2016/0231693 | A1 | 8/2016 | Kitamura | |
| 2016/0349664 | A1 | 12/2016 | Sawashima | |
| 2017/0010580 | A1 | 1/2017 | Yoshimura et al. | |
| 2017/0261921 | A1 | 9/2017 | Kawamura et al. | |

* cited by examiner

IMAGE FORMING APPARATUS

This application is a divisional of application Ser. No. 15/451,532, filed Mar. 7, 2017.

FIELD OF THE INVENTION AND RELATED ART

The present invention relates to an image forming apparatus, such as a copying machine, a printer, a facsimile machine or a multi-function machine, in which an image is formed using an electrophotographic type, an electrostatic recording type, or the like.

As the image forming apparatus of the electrophotographic type, there is an image forming apparatus having an in-line constitution in which a plurality of photosensitive members and process means (charging means, developing means, cleaning means) actable on the photosensitive members are provided and a single belt contactable to each of the photosensitive members is provided and in which a color image is formable on a transfer(-receiving) material.

In recent years, as market needs, shortening of a first print out time (FPOT) of the image forming apparatus has been strongly desired. Further, also from the viewpoint of usability, it can be said that the shortening of the FPOT is particularly effective. In such a situation, in order to shorten the FPOT, it is important that a time from reception of a print instruction from a personal computer or the like until development is first started is shortened. For this reason, it is required that the FPOT is shortened by reducing a time of movement of a developing roller, which first starts the development, from a spaced position to a contact position.

Further, there is an image forming apparatus of a contact development type in which the development is carried out in a state in which the developing roller is contacted to the photosensitive member. In the case where the contact development type is used, a lowering in lifetime due to abrasion of a photosensitive member surface layer by sliding with the developing roller and generation of waste of a developer and contamination of the transfer material due to deposition of the developer on the photosensitive member in a period other than during image formation are possible. Further, a phenomenon such as deformation of the developing roller due to maintenance of a state in which the developing roller is contacted to the photosensitive member and is at rest for a long time can generate. For this reason, it is preferable that a stand-by position spaced from the contact position by a predetermined amount is provided.

Further, in order to minimize the above-described waste of the developer, it is also important that the developing roller is quickly moved from the contact position to the stand-by position. Further, for transition between the contact position and the stand-by position, it is desirable from the viewpoints of the shortening of the FPOT and improvement in lifetime of the developing means that parallelism between the developing roller and a photosensitive drum is high.

In Japanese Laid-Open Patent Application (JP-A) 2013-195541, a constitution in which in the case where the contact development type is applied to the image forming apparatus having the in-line constitution, a developing unit can be pulled out relative to a casing along an axial direction of the photosensitive drum while enabling contact and separation between the developing roller and the photosensitive drum is proposed. Specifically, in addition to the contact and separation between the developing roller and the photosensitive drum by a driving means of the image forming apparatus in a closed state of an access door, the developing roller can be spaced from the photosensitive drum also by changing a state of the access door to the photosensitive drum and the developing roller from the closed state to an open state. For this reason, in JP-A 2013-195541, the access door as an openable member is provided with a contact-and-separation means.

However, in JP-A 2013-195541, a constitution in which the developing roller can be spaced from the photosensitive drum always in interrelation with opening of the access door when the driving means of the image forming apparatus for carrying out contact and separation between the developing roller and the photosensitive drum in the closed state is not only normal but also abnormal is employed. For this reason, even when the driving means of the image forming apparatus for carrying out the contact and separation between the developing roller and the photosensitive drum is normal, there is a possibility that a load on a user for opening and closing the access door becomes large.

Further, in JP-A 2013-195541, in order to realize engagement and drive-transmission between a single contact-and-separation means provided to the access door and another contact-and-separation means provided at a rear portion of the image forming apparatus, a coupling member urged by a spring is provided. For that reason, an urging force by the spring always acts in a state other than the open state of the access door. As a result, there is a possibility that warpage and deformation of the access door by the urging force are guided and an outer appearance of the access door is impaired. Further, there is also a liability that an operating force when the user closes the access door increases, so that it is also predicted that usability is impaired.

Further, in JP-A 2013-195541, the contact-and-separation means, provided along a front-rear direction of the image forming apparatus, for moving the respective developing rollers from the stand-by position to the contact position or from the contact position to the stand-by position are connected and engaged with each other by a shaft provided with a coupling and a pinion gear at both end portions. For this reason, when the developing roller is contacted to and spaced from the photosensitive drum, there is a possibility that a difference in contact and separation time of each developing roller between a front side and a rear side of the image forming apparatus guides exists due to distortion of the shaft. In this case, in control of the image forming apparatus, time setting on the basis of ideal contact and separation has to be made, and therefore there is also a possibility that the set time constitutes an obstacle to the shortening of the FPOT.

SUMMARY OF THE INVENTION

A principal object of the present invention is to provide an image forming apparatus capable of reducing an opening and closing load of an openable member during a normal operation by causing forced transition to development spacing (separation) interrelated with opening of the openable member to act when a spaced (separated) amount by a contact-and-separation means does not reach a predetermined amount and not to act when the spaced amount by the contact-and-separation means is larger than the predetermined amount.

According to an aspect of the present invention, there is provided an image forming apparatus comprising: a movable unit including a regulating portion for regulating a position of a developing unit for supporting a developer carrying member and movable between a contact position for permitting contact of the developer carrying member with an image bearing member and a spaced position for permitting spacing of the developer carrying member from the image bearing member; a driving member for moving the movable unit from the contact position to the spaced position, the driving member being displaceable between a contact phase for permitting location of the movable unit at the contact position and a spaced phase for maintaining the movable unit at the spaced position; an openable member for opening and closing an opening provided for demounting the developer carrying member and/or the image bearing member from a main assembly of the image forming apparatus; and a pressing member for pressing and moving the movable unit by being moved in interrelation with an opening operation of the openable member, wherein when the driving member is displaced from the contact phase to the spaced phase, the movable unit is moved from the contact position to the spaced position, wherein when the openable member is opened in a state in which the driving member is in the contact phase, the pressing member presses and moves the movable unit by a first movement amount from the contact position to the spaced position, and wherein when the openable member is opened in a state in which the driving member is in the spaced phase, the pressing member does not move the movable unit or moves the movable unit by a second movement amount smaller than the first movement amount.

Further features of the present invention will become apparent from the following description of exemplary embodiments with reference to the attached drawings.

BRIEF DESCRIPTION OF THE DRAWINGS

FIG. 18 is a perspective view, of a part of the image forming apparatus in the Third Embodiment, showing a guide rail, a shaft interrelated with an access door, a spacing cam, an interrelating lever and the like.

DESCRIPTION OF EMBODIMENTS

Embodiments of the present invention will be described specifically with reference to the drawings.

First Embodiment (Image Forming Apparatus)

Figure 1:
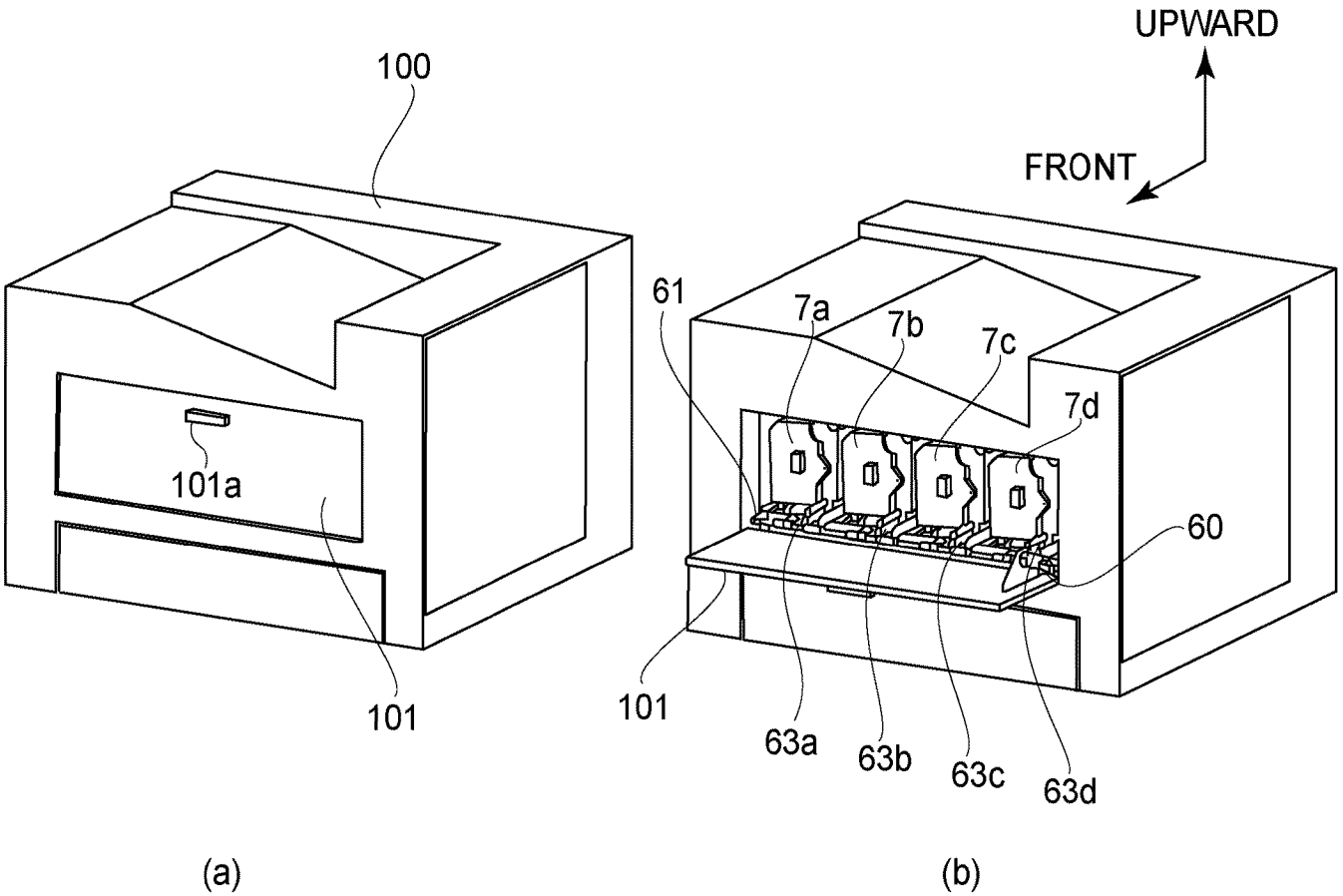
In FIG. 1, (a) and (b) are schematic perspective views of an image forming apparatus in a First Embodiment.

In FIG. 1, (a) and (b) are perspective views of a printer 100 as an image forming apparatus in which a process cartridge is detachably mountable to an image forming apparatus main assembly (apparatus main assembly). In FIG. 1, (a) is the perspective view showing a closed state of an access door 101 as an openable member for opening and closing an opening provided in the apparatus main assembly for exchanging a process cartridge 7. Further, in FIG. 1, (b) is the perspective view showing an open state, and when the access door 101 is opened, the process cartridge 7 can be pulled out in an apparatus front (surface) direction.

Figure 2:
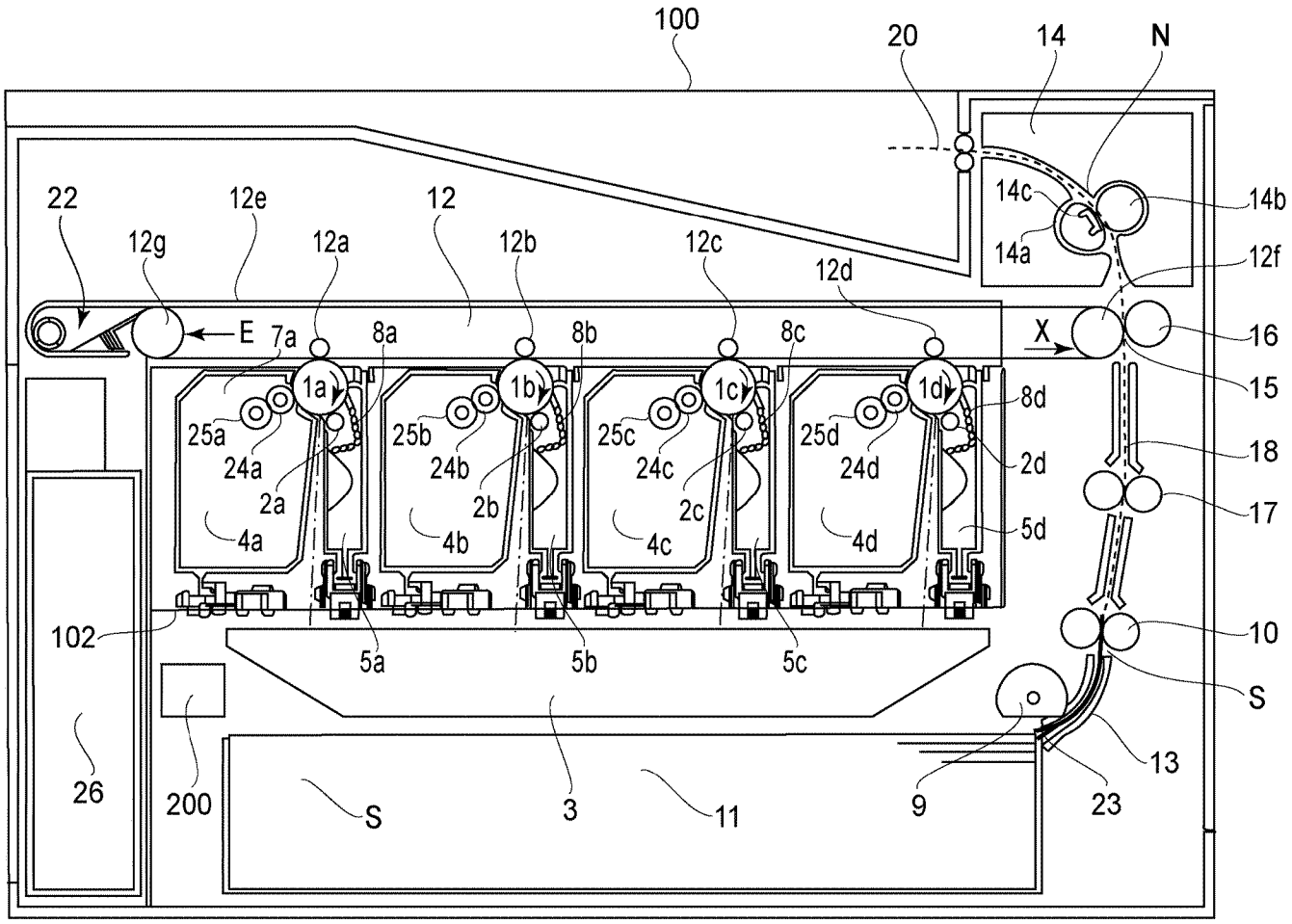
FIG. 2 is a schematic sectional view of the image forming apparatus in the First Embodiment.

FIG. 2 is a schematic sectional view of the printer 100. At a lower portion of the printer 100, a cassette 11 is accommodated so as to be pulled out. In the cassette 11, transfer (-receiving) materials S are stacked and accommodated and are separated and fed one by one. The printer 100 includes, as image forming means juxtaposed in line, process cartridges 7*a*, 7*b*, 7*c*, 7*d* (process cartridges 7) corresponding to colors of yellow (Y), magenta (M), cyan (C), black (K), respectively.

In the process cartridges 7, photosensitive drums 1*a*, 1*b*, 1*c*, 1*d* (photosensitive drums 1) which are image bearing members, charging devices 2*a*, 2*b*, 2*c*, 2*d* for negatively charging uniformly surfaces of the photosensitive drums 1, developing units 4*a*, 4*b*, 4*c*, 4*d* (devices 4) for developing electrostatic latent images as toner images by depositing toners on the electrostatic latent images, cleaning blades 8*a*, 8*b*, 8*c*, 8*d* for removing residual toners remaining on the photosensitive drums 1, and cleaner units 5*a*, 5*b*, 5*c*, 5*d* including toner containers for accommodating the respective color toners are provided.

The developing units 4 rotatably support developing roller 24*a*, 24*b*, 24*c*, 24*d* as developer carrying members urged against the image bearing members at contact positions to deposit the toners on the image bearing members, and rotatably support developer applying rollers 25*a*, 25*b*, 25*c*, 25*d*.

Herein, the contact position is a developing position where the toner image is formable by depositing the toner on the electrostatic latent image on the photosensitive drum 1, and is a position where the developing roller 24 is in contact with or adjacent to the photosensitive drum 1. That is, when the contact position is such a position for forming the toner image by depositing the toner on the electrostatic latent image on the photosensitive drum 1, the developing roller 24 may also be in non-contact with the photosensitive drum 1. Also in this case, the position is referred to as the contact position for convenience.

Incidentally, the apparatus first (surface) direction is a direction parallel to an axial direction of the photosensitive drum 1 and an axial direction of the developing roller 24 in a state in which the process cartridge 7 is mounted in the apparatus main assembly.

Figure 3:
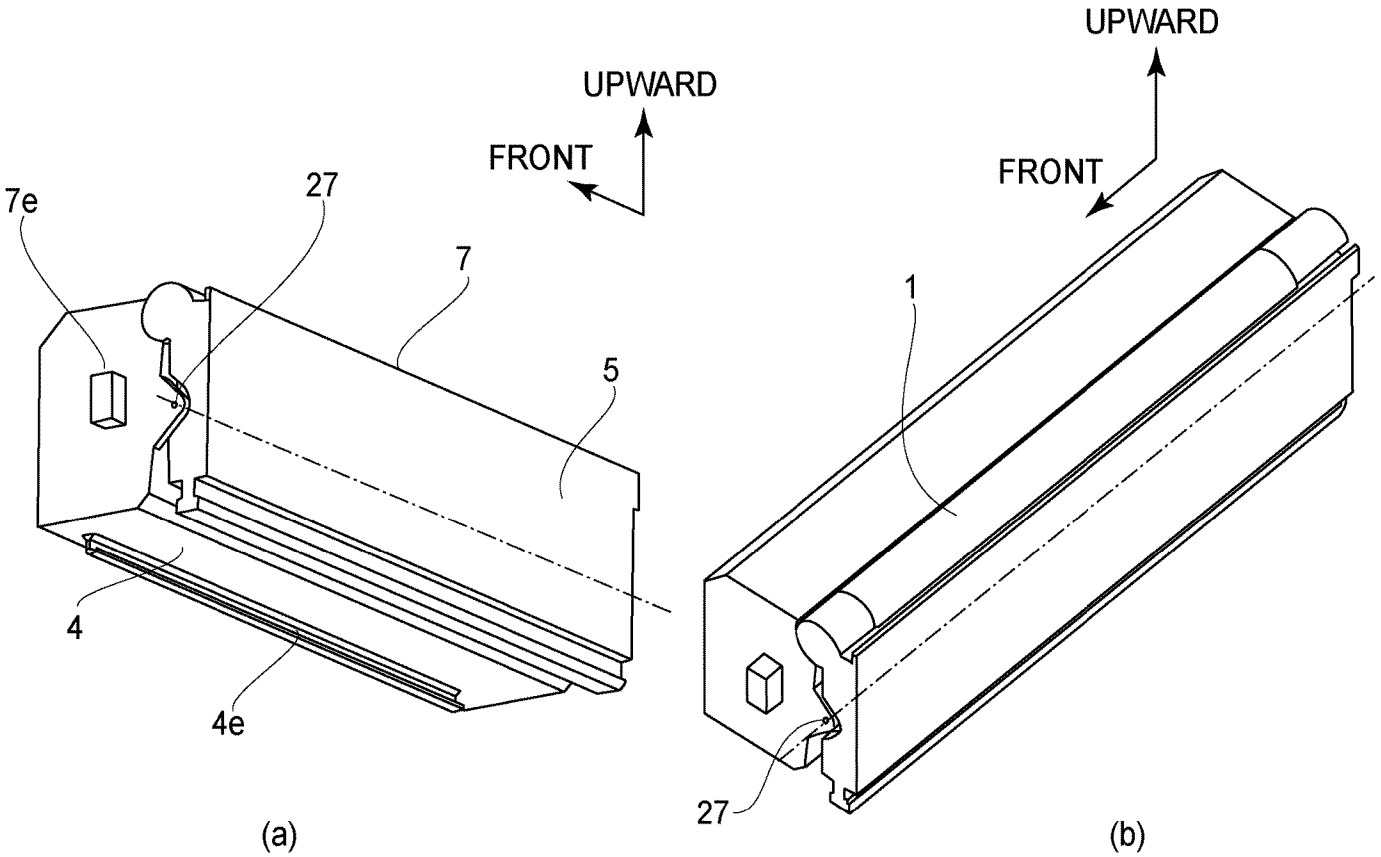
In FIG. 3, (a) and (b) are schematic perspective views of a process cartridge in the image forming apparatus in the First Embodiment.

In FIG. 3, (a) and (b) are perspective views of the process cartridge 7. A substantially L-shaped rib 4*e* is provided under the developing unit 4, and a grip portion 7*e* is provided in a front side of the developing unit 4. The developing unit 4 is swingable about a pin 27, provided as a rotation center along a front-rear direction, relative to the cleaner unit 5, and the developing roller 24 is capable of being contacted to and spaced from the photosensitive drum 1 (movable between the contact position and a spaced position).

By employing such a constitution, in synchronism with timing when the toner is deposited on the electrostatic latent image formed on the photosensitive drum 1, the developing roller 24 is contacted to the photosensitive drum 1 (contact state). Then, in a period other than the contact state (period), the developing roller 24 is spaced from the photosensitive drum 1 as much as possible (stand-by state), so that lifetimes of the developing roller 24 and the photosensitive drum 1 are improved. Below the process cartridge 7, a scanner unit 3 for forming the electrostatic latent image on the photosensitive drum 1 by irradiating the photosensitive drum 1 with a laser beam on the basis of image information is provided, and above the process cartridge 7, an intermediary transfer unit 12 is provided.

The intermediary transfer unit 12 includes primary transfer rollers 12*a*, 12*b*, 12*c*, 12*d*, a cylindrical endless intermediary transfer belt 12*e*, a driving roller 12*f*, a tension roller 12*g* and a cleaning device 22 for removing the toner on the intermediary transfer belt 12*e*. The cleaning device 22 is disposed upstream of a primary transfer portion, formed by the photosensitive drum 1*a* and the primary transfer roller 12*a*, with respect to a movement direction of the intermediary transfer belt 12*e* (an arrow X direction shown in FIG. 2), and is disposed downstream of a secondary transfer portion, formed by the driving roller 12*f* and a secondary transfer roller 16, with respect to the movement direction of the intermediary transfer belt 12*e*.

The cleaning device 22 is positioned and held by a shaft of the tension roller 12*g*. Accordingly, the cleaning device 22 is configured to follow a positional fluctuation of the tension roller 12*g*. Further, the intermediary transfer belt 12*e* and the cleaning device 22 are consumables, and therefore the intermediary transfer unit 12 provided integrally with the cleaning device 22 is detachably mountable to the apparatus main assembly. Further, residual toner on the intermediary transfer belt 12*e* collected by the cleaning device 22 is accumulated in a toner collecting container 26 provided in the printer 100.

The driving roller 12*f* is rotationally driven by a driving source such as a motor (not shown), so that the intermediary transfer belt 12*e* is rotated at a predetermined speed in the arrow X direction shown in FIG. 2. For primary transfer, positive bias voltages are applied to the primary transfer rollers 12*a*, 12*b*, 12*c*, 12*d*, and a potential difference thereof with the negatively charged surface (potential) of the photosensitive drums 1, so that the toner images are transferred (primary-transferred) onto the intermediary transfer belt 12*e*.

The toner images are primary-transferred superposedly at the primary transfer portions formed between the primary transfer rollers 12*a*, 12*b*, 12*c*, 12*d* and associated photosensitive drums 1*a*, 1*b*, 1*c*, 1*d*, respectively. The toner images transferred on the intermediary transfer belt 12*e* are transferred onto the transfer material S at a secondary transfer portion 15 formed by the driving roller 12*f* and the secondary transfer roller 16. Thereafter, the transfer material S passes through a fixing device 14 for fixing the transferred images and is fed to discharging roller pair 20 and then is discharged on a transfer material stacking portion.

Here, a feeding device 13 includes a sheet feeding roller 9 for feeding the transfer material S from an inside of a sheet feeding cassette 11 in which the transfer materials S are accommodated and includes a conveying roller pair 10 for conveying the fed transfer material S. The transfer materials S are press-contacted to the sheet feeding roller 9 and are separated one by one by a separation pad 23 (friction piece separation type), and the separated transfer material S is fed.

Then, the transfer material S fed from the feeding device 13 is conveyed to the secondary transfer portion 15 by a registration roller pair 17. The fixing device 14 applies heat and pressure to the image formed on the transfer material S and fixes the image on the transfer material S. A cylindrical feeding belt 14*a* is guided by a belt guide member 14*c* to which a heat generating means such as a heater is bonded. An elastic pressing roller 14*b* sandwiches the feeding belt 14*a* with the belt guide member 14*c*, so that a feeding nip N with a predetermined width is formed with a press-contact force between the pressing roller 14*b* and the belt guide member 14*c*.

The printer 100 as the image forming apparatus includes, as described below, a controller 200 for controlling an image forming operation by the printer 100.

(Controller)

Figure 4:
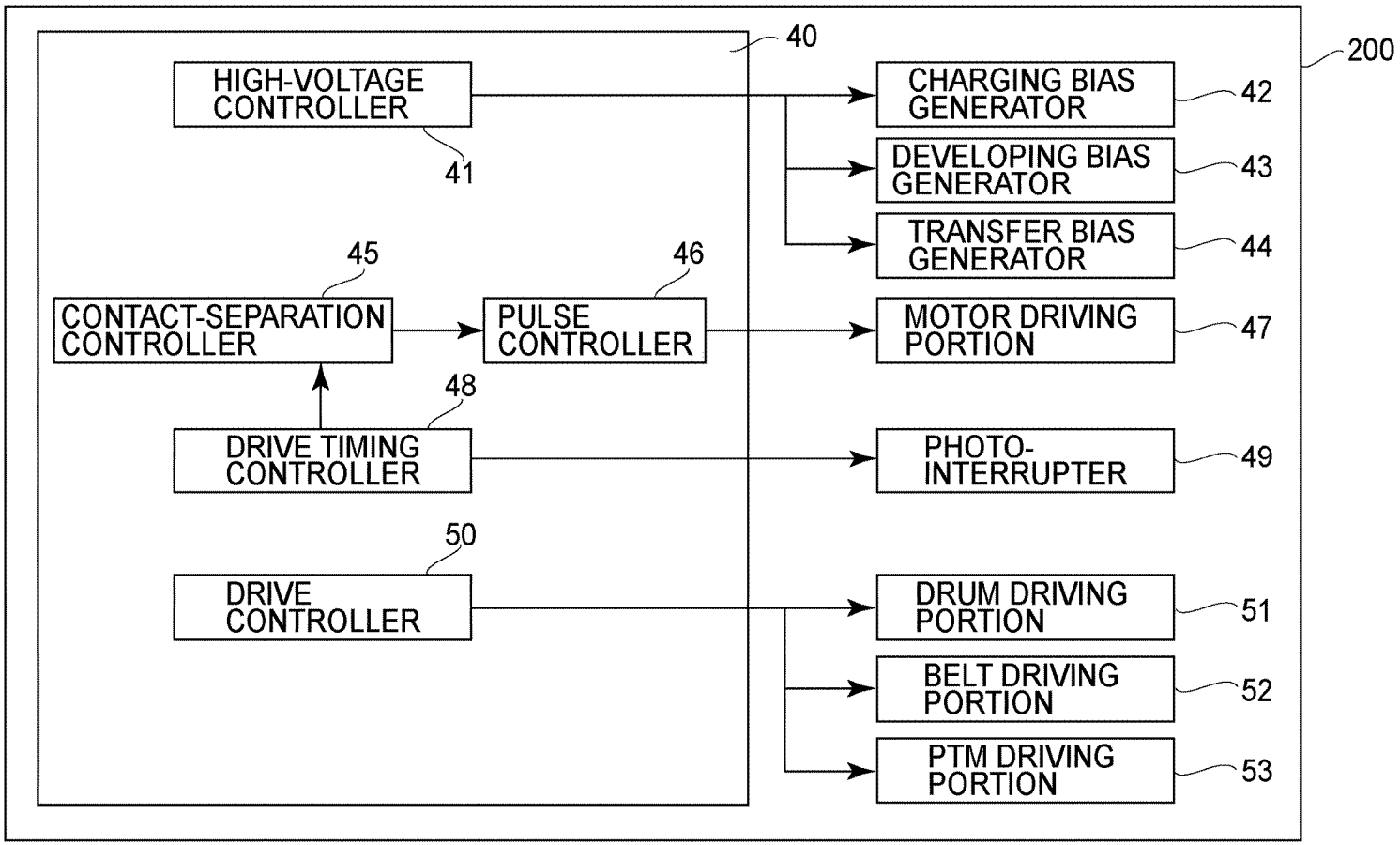

The controller 200 for controlling the image forming operation will be described. FIG. 4 is a block diagram showing a constitution of the controller 200 of the image forming apparatus. The printer 100 includes the controller 200 in which an electric circuit for effecting control thereof is mounted, and a CPU 40 is mounted in the controller 200. The CPU 40 includes a drive controller 50 for effecting feeding of the transfer material S and control of a driving source for the development contact 7 or the like, a high-voltage controller 41 for effecting control relating to image formation, a contact-and-separation (spacing) controller 45 for controlling contact and spacing (separation) of the developing roller 24, and the like, and collectively controls an operation of the image forming apparatus.

The drive controller 50 controls, as a drive control portion during image formation, a photosensitive drum driving portion 51, an intermediary transfer belt driving portion 52 and a primary transfer mechanism driving portion 53. The high-voltage controller 41 controls a charging bias generating portion 42, a developing bias generating portion 43 and a transfer bias generating portion 44 which are used for generating voltages necessary for the image formation. Further, the controller 200 includes a motor driving IC 47 for controlling drive of a contact-and-separation motor 90 (FIG. 5) of a development contact-and-separation mechanism described later. The CPU 40 sends a pulse signal (in this embodiment, an exciting type is a two-phase excitation type) to the motor driving IC 47, and thus switches excitation of the motor 90.

The motor driving IC 47 receiving the pulse signal controls a direction of a current flowing through a coil of the motor 90 correspondingly to the pulse signal and has a mechanism of rotating a rotor magnet by reversing a field (magnetic) pole in the motor 90 at that time. A rotational speed of the motor 90 depends on a frequency of the pulse signal sent from the CPU 40 (hereinafter, this frequency is defined as a drive frequency), and as the drive frequency is higher, a reverse cyclic period of the field pole is shorter and also the rotational speed of the motor is faster.

The contact-and-separation controller 45 for controlling timing or the like of the contact and separation (spacing) controls a pulse controller 46, and the pulse signal generated by the pulse controller 46 is sent to a motor driving portion (motor driving IC) 47. Further, a signal of a photo-interrupter 49 which is a position detecting sensor described is sent to a driving timing controller 48 and is used for contact-and-separation control.

In this embodiment, transition from development contact to development spacing (separation), a first mode and a second mode are executable. In the first mode, a spaced amount between the image bearing member and the developer carrying member is made a predetermined amount by a contact-and-separation means (FIGS. 5-7) described later. On the other hand, in the second mode, in the case where the spaced amount between the image bearing member and the developer carrying member does not reach the predetermined amount by the contact-and-separation means (during a stop of an actuator), the spaced amount between the image bearing member and the developer carrying member is made the predetermined amount in interrelation with an opening operation of an access door described later.

In a state in which the spaced amount between the image bearing member and the developer carrying member does not reach the predetermined amount by the contact-and-separation means (during the stop of the actuator), when the access door is opened, the second mode is automatically executed.

In this embodiment, in transition in a reverse (opposite) direction from the development spacing to the development contact, the contact-and-separation means (FIGS. 5-7) is used.

Figure 5:
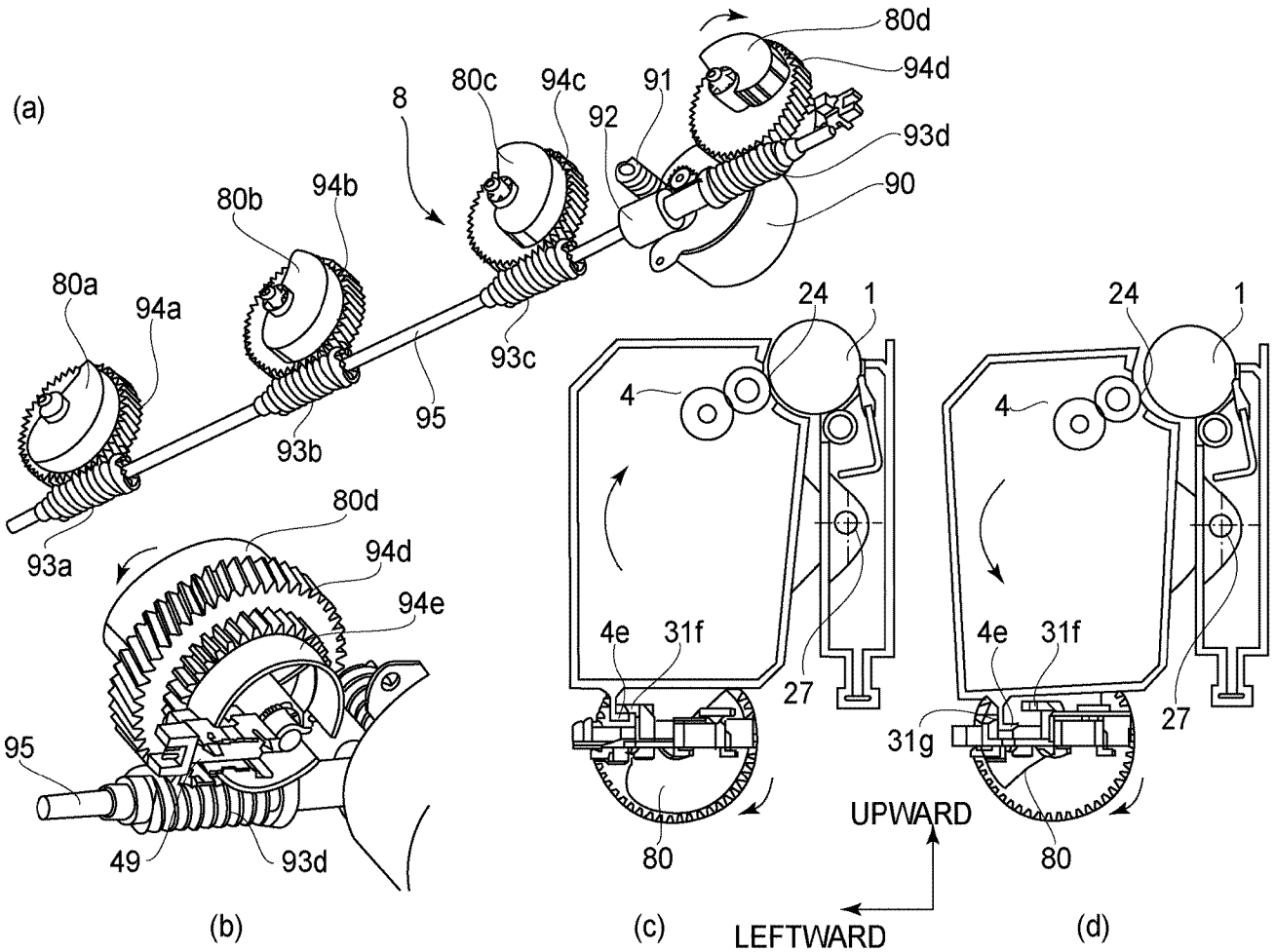
In FIG. 5, (a) is a perspective view of a contact-and-separation means (driving portion), (b) is a perspective view showing a relationship between a cam gear and a photo-interruptor, (c) is a schematic sectional view of a part of the contact-and-separation means during development contact, and (d) is a schematic sectional view of a part of the contact-and-separation means during development spacing, in the First Embodiment.
Figure 6:
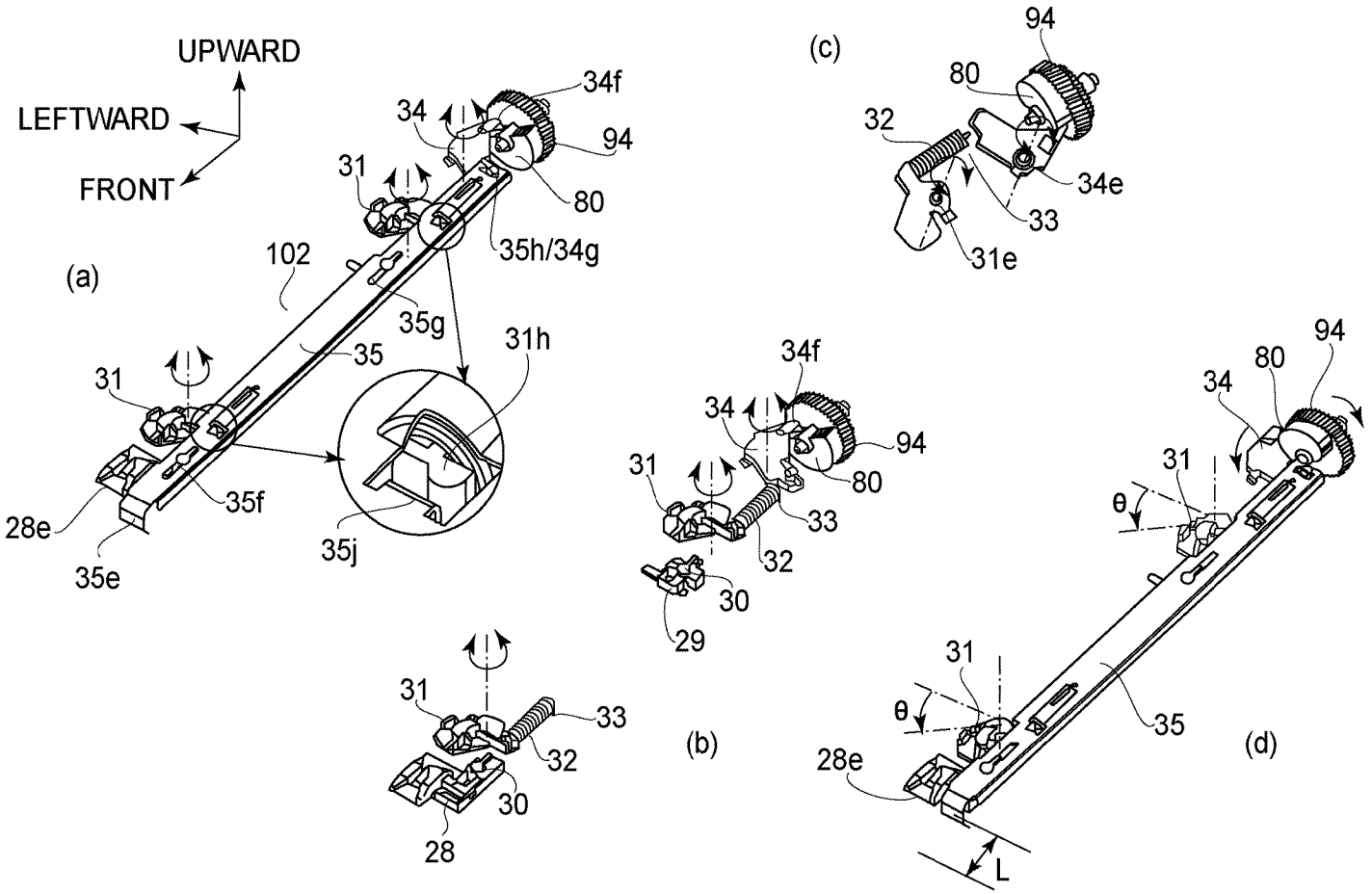
In FIG. 6, (a) is a perspective view of the contact-and-separation means, (b) is a perspective view of the contact-and-separation means (excluding a slider), (c) is a perspective view of the contact-and-separation means (a lever and the cam gear as seen from a lower portion of the image forming apparatus in a rear side of the image forming apparatus), and (d) is a perspective view of the contact-and-separation means during development spacing in the First Embodiment.
Figure 7:
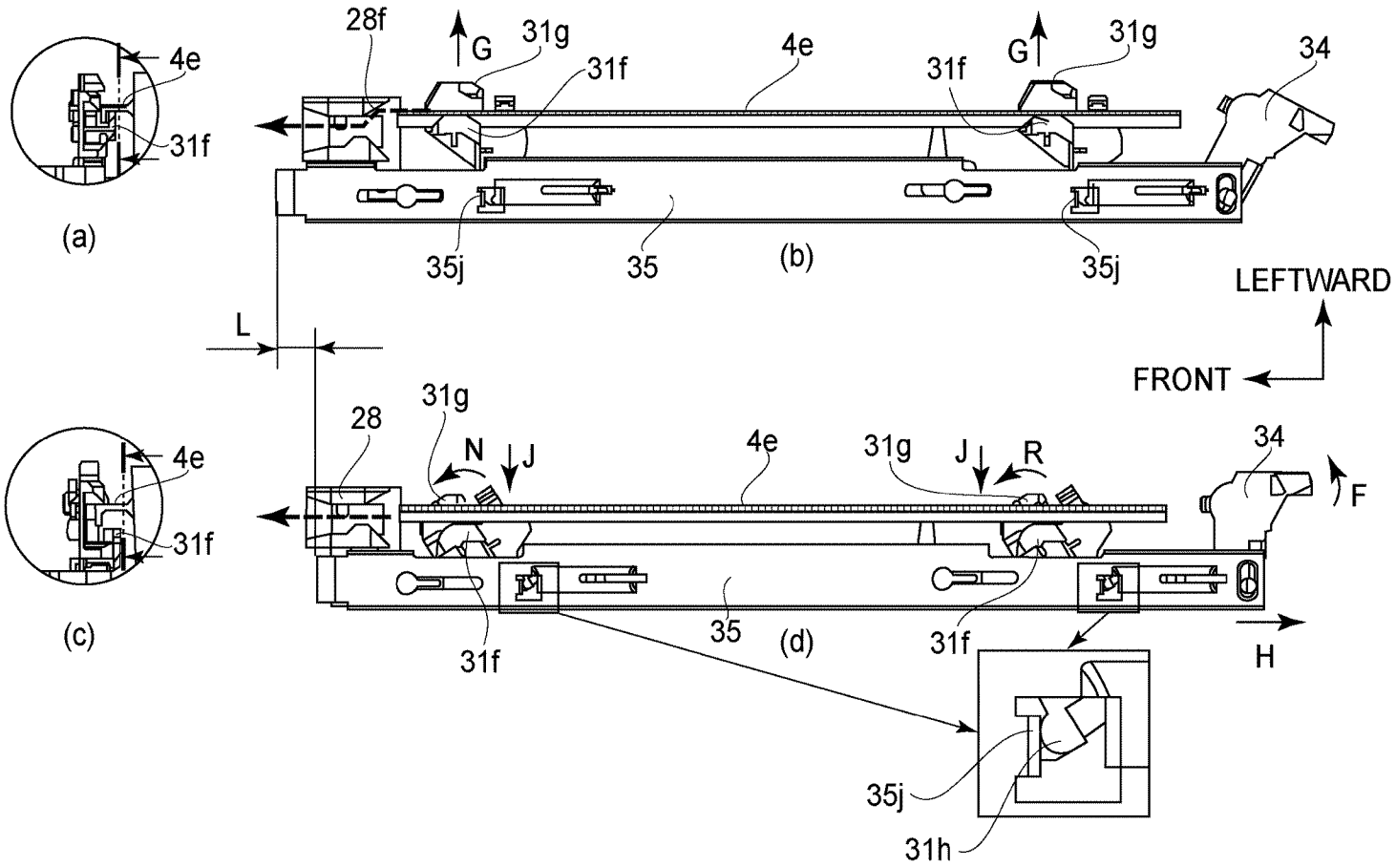
In FIG. 7, (a) is a partly enlarged view of the contact-and-separation means during development contact in a front side of the image forming apparatus, (b) is a schematic view of the contact-and-separation means during development contact as seen from an upper portion of the image forming apparatus, (c) is a partly enlarged view of the contact-and-separation means during development spacing in the front side of the image forming apparatus, and (d) is a schematic view of the contact-and-separation means during development spacing as seen from the upper portion of the image forming apparatus, in the First Embodiment.

(Contact and Separation Means (FIGS. 5-7)

The contact-and-separation means (FIGS. 5-7) will be described by taking the transition from the development contact to the development spacing in the first mode as an example. An outline thereof is shown below. That is, first a first cam 80 is rotated by rotation of a motor 90 for driving the contact-and-separation means. The first cam 80 and the motor 90 function as a driving member for moving a movable unit (movable member 31, lever 34, slider 35) from the contact position to the spaced position.

As a link mechanism in a horizontal surface, rotation of the lever 34, movement of the slider 35 in a direction (axial direction of the photosensitive drum 1) perpendicular to the first cam 80) and displacement of the pressing spring 32, in the axial direction, for urging the developer carrying member against the image bearing member are used.

By rotation of the movable member 31 rotated in interrelation with the displacement of the slider 35, a rib 31*f* of the movable member 31 is spaced from a rib 4*e* of the developing unit 4, so that a rib 31*g* urges the rib 4*e* ((d) of FIG. 5). As a result, the contact-and-separation means changes in a state from the development contact to the development spacing.

Specifically, in (a) of FIG. 5, with an increase in cam diameter of the first cam 80 (80*a*, 80*b*, 80*c*, 80*d*), the lever 34 is first swung by being urged by the first cam 80 as shown by an arrow F in (d) of FIG. 7. As a result, the slider 35 connected with the lever 34 moves linearly in a direction from the front surface toward a rear surface as shown by an arrow H. A bent portion 35*j* is provided at two positions at two contact portions each between the pressing spring 32 and the slider 35, so that the bent portion 35*j* can contact a rib 31*h* (partially enlarged view as (d) of FIG. 7).

For this reason, when the slider 35 moves in a certain amount or more, the movable member 31 starts rotation by the slider 35 as shown by an arrow R in (d) of FIG. 7. Then, the pressing spring 32 is gradually compressed.

Then, the rib 4*e* of the developing unit 4 is moved from a left-hand side toward a right-hand side of the apparatus by the rib 31*g* of the movable member 31 (arrow J of (d) of FIG. 7).

The contact-and-separation means will be specifically described with reference to each of FIGS. 5, 6 and 7.

1) FIG. 5

In FIG. 5, 8*a*) is a perspective view of a driving portion of the contact-and-separation means, (b) is a partial device of a periphery of a photo-interruptor 49 of the driving portion of the contact-and-separation means, (c) is a schematic sectional view of the contact-and-separation means during development contact, and (d) is a schematic sectional view of the contact-and-separation means during development spacing. As the motor 90 which is a driving source for switching the position (contact position, spaced position) of the developing roller 24 relative to the photosensitive drum 1, a stepping motor is used and connected with a drive switching shaft 95 via gears 91, 92.

The shaft 95 is provided with worm gears 93 for driving cam gears 94 for the respective colors. The shaft 95 is rotated by rotation of the motor 90, so that the cam gears 94 are rotated and a rotational phase of the first cam 80 (80*a*, 80*b*, 80*c*, 80*d*) is changed between a contact phase and a spaced phase. The first cam 80 is capable of regulating positions of the developing unit 4 and the developing roller 24 through the contact-and-separation means described later and shown in FIG. 6 and presses the rib 4*e* of the developing unit 4, so that contact and spacing between the photosensitive drum 1 and the developing roller 24 are switched.

Thus, the shaft 95 and the first cams 80 (80*a*, 80*b*, 80*c*, 80*d*) shown in (a) of FIG. 5 are rotationally driven by a single motor 90, so that the phase is displaceable between the contact phase and the spaced phase. As a result, the position (development contact position, development spaced position) of the developing roller 24 relative to the photosensitive drum 1 is made changeable. Further, as shown in (c) and (d) of FIG. 5, the developing unit 4 is rotatable about the pin 27 as a swing center while rotatably supporting the developing roller 24, and is urged in the clockwise direction (direction in which the developing unit 4 contacts the first cam 80) by the pressing spring (FIG. 6) as the urging means.

2) FIG. 6

In FIG. 6(*a*) to (*d*) are perspective views of a structure, of the contact-and-separation means, for urging the process cartridge 7. In FIG. 6, (a) is the perspective view showing an urging structure at one station during development contact, (b) is the perspective view of the urging structure from which the slider 35 is removed from (a) of FIG. 6, (c) is the perspective view showing a back side of parts in a back-surface-side of the apparatus, and (d) is the perspective view of the urging structure during development spacing.

In (a) to (c) of FIG. 6, the lever 34 following the first cam 80 is provided. The lever 34 is provided with a boss 34*e* rotatably held in a hole (not shown) provided in a frame 102 (FIG. 2). Further, the lever 34 is provided with another boss 34*f* ((b) of FIG. 6), and the boss 34*f* engages with an elongated circular hole 35*h* ((a) of FIG. 6).

As shown in (a) and (d) of FIG. 6, the slider 35 is slidably held linearly in a front (surface)-rear (surface) direction of the apparatus by slide guides 28 and 29 ((b) of FIG. 6) fixed to the frame 102. The slide guides 28 and 29 are provided with two pins 30, and the pins 30 function as retaining pins for preventing movement of the slider 35 toward an upward direction of the apparatus.

Further, as shown in (b) of FIG. 6, at two positions with respect to the front side and the rear side of the apparatus, the movable member 31, the pressing spring (compression spring) 32 and a spring seat 33 are provided. The movable member 31 is provided with a boss 31*e* and is rotatable relative to the frame 102 similarly as the lever 34. The spring seat 33 is fixed to the frame 102, and the pressing spring 32 is mounted to the apparatus main assembly between the movable member 31 and the spring seat 33.

In this embodiment, in (a) of FIG. 6, the first cam 80 is in the contact phase, and the movable member 31 is in the contact phase. When the first cam 80 is rotated to the spaced phase from this state, the lever 34 is rotated in an arrow direction in (d) of FIG. 6 by being pressed (urged) by the first cam 80, so that the slider 35 moves from the front side of the apparatus in the rearward (rear surface) develop by L and is in a state shown in (d) of FIG. 6. At that time, the movable member 31 rotates from the contact position about the boss 31*e* correspondingly to an angle θ shown in (d) of FIG. 6 and reaches the spaced position.

As a result, the contact-and-separation can be changed in state from the development contact state of (c) of FIG. 5 to the development spaced state of (d) of FIG. 5. Further, a relative difference between the front-side movable member 31 and the rear-side movable member 31 of the apparatus can be reduced to a small value, so that a degree of play until the movable member 31 starts movement is small, and therefore the contact-and-separation means can quickly change in state to the development spaced state and has a constitution advantageous in terms of shortening of FPOT (first print out time).

3) FIG. 7

In FIG. 7, (a) is a partly enlarged view of the contact-and-separation means during development contact as seen from the front side of the apparatus, and (b) is a partial sectional view of the contact-and-separation means showing a relationship between the contact-and-separation means and the rib 4*e* of the developing unit 4 as seen from above the apparatus. In FIG. 7, (c) and (d) are a partly enlarged view and a partial sectional view corresponding to (a) and (b) of FIG. 7, respectively, showing a corresponding relationship during development spacing. During development contact, by an elastic force of the pressing spring 32, the rib 31*f* of the movable member 31 disposed in the contact position urges the rib 4*e* of the developing unit 4 at each of two positions in the front and rear sides of the apparatus as shown by an arrow G in (b) of FIG. 7. As a result, the developing roller 24 is contacted to the photosensitive drum 1.

On the other hand, during development spacing (stand-by state), the lever 34 is urged by the first cam 80, so that the pressing spring 32 is in a compressed state. The rib 31*f* of the movable member 31 disposed in the spaced position urges the rib 4*d* of the developing unit 4, at each of two positions different with respect to the frontward (front surface) direction of the apparatus, in an arrow J direction in d) of FIG. 7. As a result, the developing roller 24 is spaced from the photosensitive drum 1.

Thus, when the first cam 80 is in the contact phase, the movable member 31 is permitted to be placed in the contact position by the elastic force of the pressing spring 32. When the first cam 80 is in the spaced phase, the first cam 80 urges the movable member 31 through the lever 34 and the slider 35 and maintains the movable member 31 at the spaced position against the elastic force of the pressing spring 32. Further, the movable member 31, and the lever 34 and the slider 35 moved together in interrelation with the movable member 31 can be collectively regarded as the movable unit.

Accordingly, it can be said that when the movable member 31 is in the spaced position, also the movable unit is in the spaced position and that when the movable member 31 is in the contact position, also the movable unit is in the contact position. Further, the ribs 31*f*, 31*g* of the movable member 31 are regulating portions for regulating the position of the developing unit 4.

(Transition from Development Contact to Development Spacing in Second Mode)

The operation in the second mode is executed, as described above, in the case where the spaced amount between the image bearing member and the developer carrying member does not reach the predetermined amount by the contact-and-separation means, i.e., when the first cam 80 is in a state in which the first cam 80 is not in the spaced phase at which development spacing is carried out. That is, in interrelation with the opening operation of the access door, the image bearing member and the developer carrying member are spaced from each other by the predetermined amount.

In this embodiment, in the second mode, in interrelation with the opening operation of the access door, at least a part of the contact-and-separation means other than the first cam 80 in the first mode is operated, so that the spaced amount between the image bearing member and the developer carrying member is a predetermined amount (these members are spaced by the predetermined amount). Specifically, as described later, the slider 35 movable in an axial direction of the image bearing member is used in operations in the first mode and the second mode in common. In the following, with reference to FIGS. 10-12, a constitution in which development spacing is made in interrelation with the opening operation of the access door 101 will be specifically described.

First, an outline will be described. In a plane perpendicular to a horizontal plane, a second cam 62 is rotated in interrelation with the opening operation of the access door 101 and contacts a portion-to-be-urged 35*e* ((a) of FIG. 6, (b) of FIG. 10) of the slider 35. Then, in the horizontal plane, through the rotation of the lever 34 and displacement of the slider 35 and the pressing spring 32 which are used as a link mechanism shown in FIG. 7, by rotation of the movable member 31 rotating in interrelation with the displacement of the slider 35, the contact position and the stand-by position are switched to each other.

Next, transition from the development contact to the development spacing in the operation in the second mode will be described with reference to each of FIGS. 10-12.

1) FIG. 10

Figure 10:
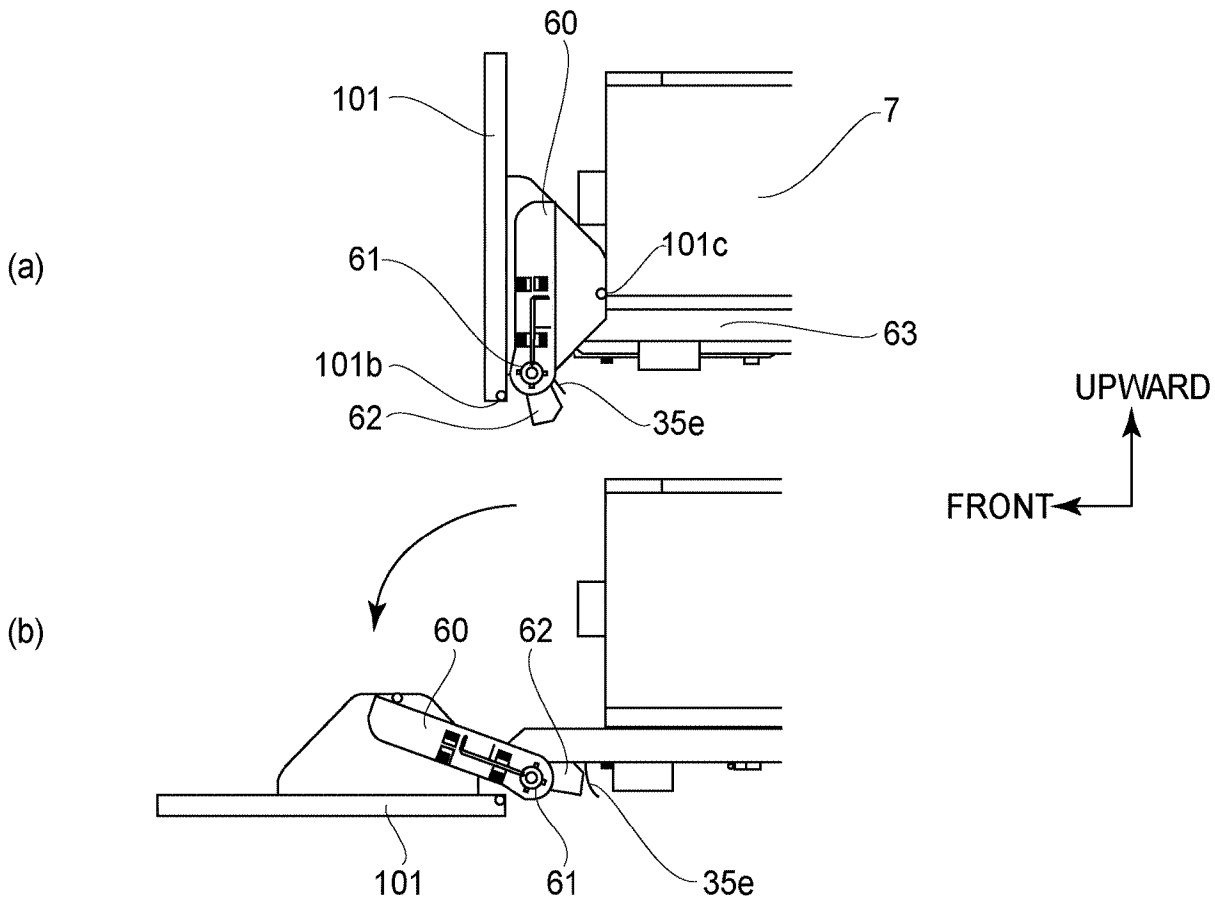
In FIG. 10, (a) and (b) are partial sectional views, as seen from a right-hand side of the image forming apparatus, for illustrating an opening and closing operation and a positional relationship among a process cartridge, a guide rail and a spacing cam, in the First Embodiment.

In FIG. 10, (a) and (b) are partly enlarged views showing an access door 101, the process cartridge 7 and a periphery of a guide rail 63 of the process cartridge 7, in which (a) shows a closed state of the access door 101, and (b) shows an open state.

The frame 102 (FIG. 2) is provided with a shaft 61 rotatably supported at ends thereof, and an interrelating lever 60 is fixed to the shaft 61. Further, correspondingly to the four stations, the spacing cams 62 are fixed to associated shafts 61 at positions opposing the associated sliders 35. The access door 101 is provided with a rotation shaft 101*b* constituting a rotational fulcrum of the access door 101. The access door 101 is provided with an engaging boss 101*c*, and during transition of the access door 101 from the closed state to the open state, the engaging boss 101*c* engages with the interrelating lever 60. Then, with the opening (operation) of the access door 101, the shaft 61 rotates in a direction indicated by a solid line in (b) of FIG. 10 by a desired angle.

2) FIG. 11

Figure 11:
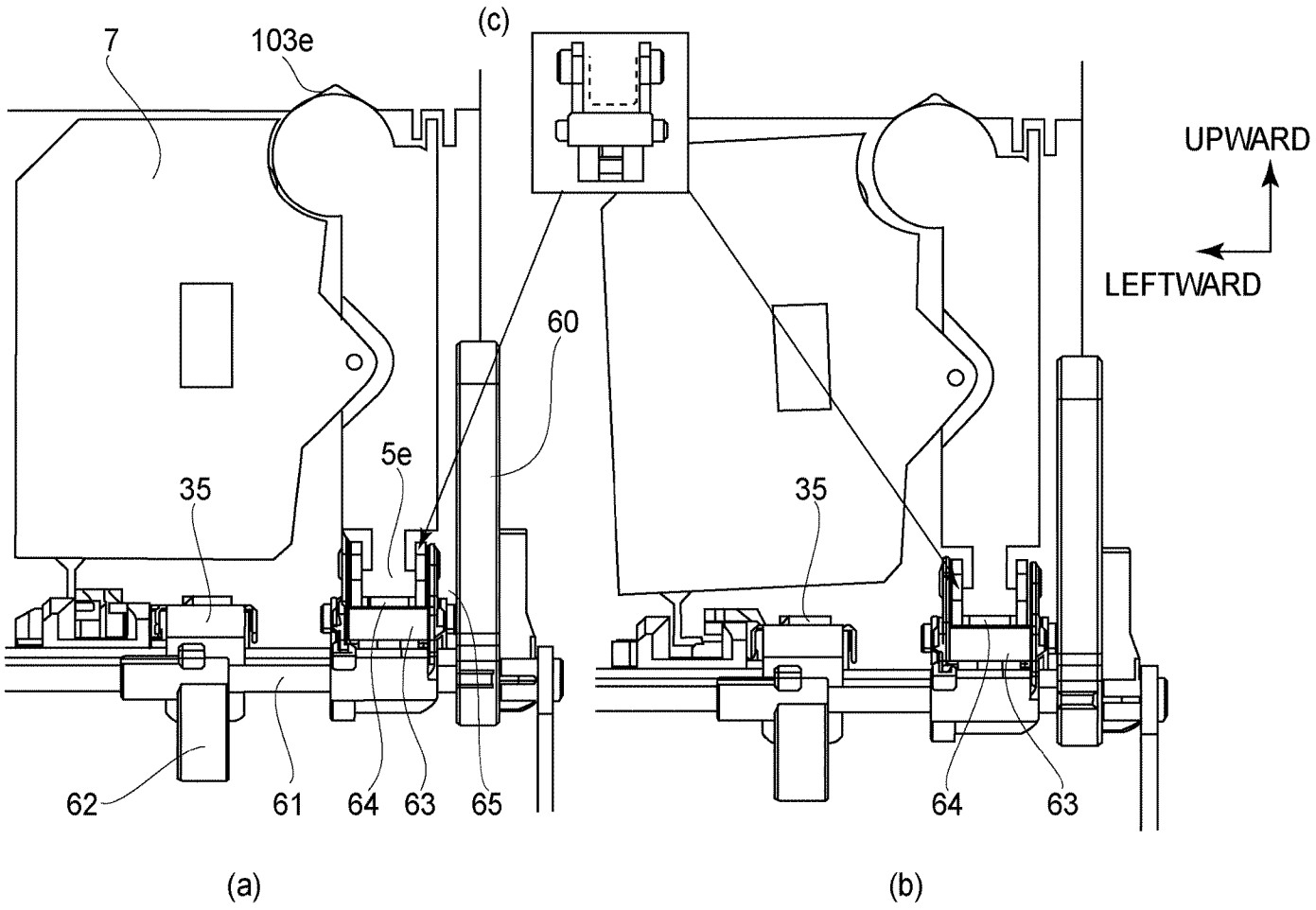
In FIG. 11, (a) to (c) are partly enlarged views, as seen from the front side of the image forming apparatus, for illustrating the opening and closing operation and the positional relationship among the process cartridge, the guide rail and the spacing cam, in the First Embodiment.

In FIG. 11, (a) is a partly enlarged view showing the K station in a state in which the access door 101 is closed as seen from the front surface in a plane perpendicular to the horizontal plane, (b) is a partly enlarged view showing the K station in a state in which the access door 101 is open as seen from the front surface in the plane, and (c) is a partly enlarged view showing a shape of only a rail 63. A lower portion 5*e* of the cleaner unit 5 of the process cartridge 7 has a substantially T-shape and engages with the guide rail 63 having a substantially U-shape in cross-section as shown by a broken line in (c) of FIG. 11.

Further, an upper portion of the cleaner unit 5 has an arcuate shape positioned at a V-shaped portion 103*e* of an upper frame. Urging against the V-shaped portion 103*e* is made by a pressing member 64 provided in the guide rail 63, and in the closed state of the access door 101, the process cartridge 7 is urged in the upward direction of the apparatus.

3) FIG. 12

Figure 12:
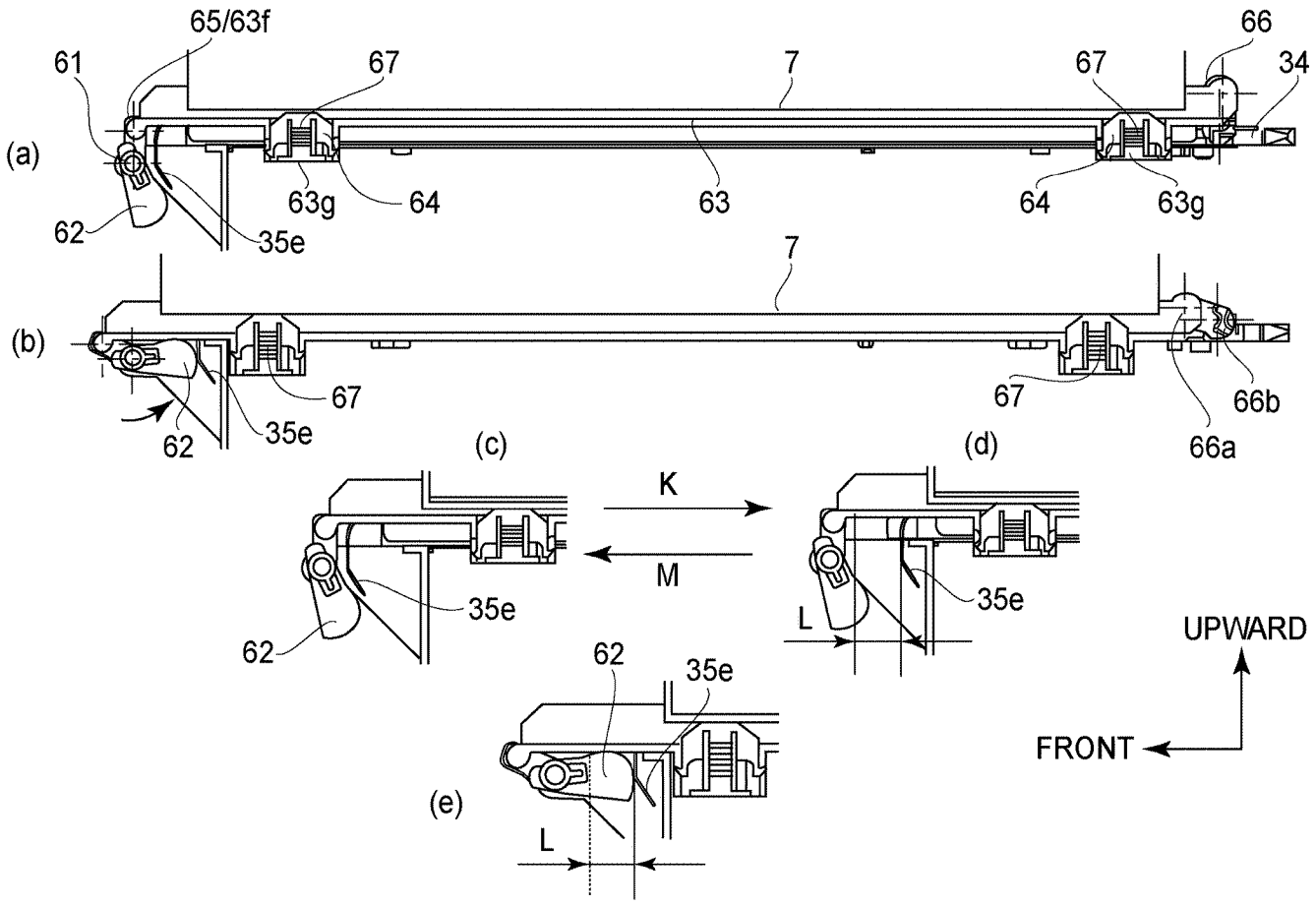
In FIG. 12, (a) to (e) are partly enlarged views, as seen from a right-hand side of the image forming apparatus, for illustrating the opening and closing operation and the positional relationship among the process cartridge, the guide rail and the spacing cam, in the First Embodiment.

In FIG. 12, (a) and (b) are schematic views showing a relationship between the guide rail 63 and the access door 101 in the plane perpendicular to the horizontal plane, in which (a) shows the closed state of the access door 101, and (b) shows the open state of the access door 101. The rail 63 is provided with urging member accommodating portions 63*g* at two positions with respect to the front-rear direction of the apparatus. Between the urging member accommodating portion 63*g* and the urging member 64, a second urging means (compression spring) 67 is provided, so that the urging member 64 urges the process cartridge 7 upward with respect to the guide rail 63 in the apparatus.

As regards the guide rail 63, a quadric parallel link as the link mechanism is formed by a rail arm 65 connecting the shaft 61 and the guide rail 63 and a rail arm 66 connecting an unshown frame and the guide rail 63 in the rear side of the apparatus. Further, between the guide rail 63 and the frame, an unshown tension spring is provided and urges the guide rail 63 in a direction from (b) of FIG. 12 to (a) of FIG. 12. As a result, by the opening and closing operation of the access door 101, the guide rail 63 and the process cartridge 7 can be urged so as to be raised and lowered.

(Development Spacing by Opening (Operation) of Access Door (Second Mode))

Subsequently, with reference to (c) to (e) of FIG. 12, a relationship between the opening (operation) of the access door 101 and the development spacing will be described. In FIG. 12, (c) shows a relationship between the spacing cam 62 and the portion-to-be-urged 35*e* of the slider 35 when the access door 101 is in the closed state and in the development contact state. Similarly, (d) of FIG. 12 shows the relationship between the spacing cam 62 and the slider 35 when the access door 101 is in the closed state and in the development spacing state.

In the development contact-and-separation operation before and after the image formation, as described above, the spacing cam 62 and the slider 35 produce motion of arrows K and M in the figures. In (d) of FIG. 12, a distance L is the same as a distance L in (d) of FIG. 6 and is a slide amount of the slider 35 in the development contact-and-separation operation.

In FIG. 12, (e) shows the case where a power source is turned off and the apparatus main assembly is at rest in a state in which the apparatus main assembly is not returned to the stand-by state (in a state in which the first cam 80 is not in the spaced phase) and thereafter the access door 101 is opened.

The case where the access door 101 is opened in a state in which the portion-to-be-urged 35*e* of the slider 35 is at rest (stop of the actuator) during movement of the portion-to-be-urged 35*e* in the distance L will be described. When the access door 101 is opened from the state of (a) and (c) of FIG. 12, the spacing cam 62 which is a second cam is rotated and moves the portion-to-be-develop 35*e* of the slider 35 in the rear surface direction of the apparatus by a maximum outer diameter portion thereof, so that the spacing cam 62 and the portion-to-be-urged 35*e* are in a state of (b) and (e) of FIG. 12. The portion-to-be-urged 35*e* is urged by the spacing cam 62 in the rear surface direction of the apparatus, so that the slider 35 is pushed in the rear surface direction of the apparatus. As a result, the movable member 31 is rotated and is in the spaced state shown in (d) of FIG. 7.

Thus, by urging the portion-to-be-urged 35*e* of the slider 35 by the contact 62 as the urging member, the movable unit (movable member 31, lever 34, slider 35) can be moved to the spaced position. A distance in which the portion-to-be-urged 35*e* is moved by the urging with the spacing cam 62 at this time (in the apparatus rear surface direction) is a first movement amount. In this case, the distance in which the portion-to-be-urged 35*e* is moved by the first movement amount is L.

In the case where a relative distance between the spacing cam 62 and the portion-to-be-urged 35*e* of the slider 35 is small due to a variation in part tolerance, i.e., even when the mechanism amount of the slider 35 by the spacing cam 62 is larger than L, a problem does not arise. This is because in the horizontal plane, the lever 34 in FIG. 7 is merely spaced from an outer diameter portion in the first cam 80 and therefore excessive stress does not generate between the first cam 80 and the spacing cam 62 which is the second cam and does not lead to breakage. By employing such a constitution, the development spacing can be realized also by opening the access door 101.

In the case where the development spacing cannot be made by the access door 101, there is a need that a user pulls out the process cartridge 7 in the development contact state in the apparatus rear surface direction indicated by an arrow of a broken line in (b) of FIG. 7 while placing the process cartridge 7 in the development spacing state. That is, there is a need that the user pulls out the process cartridge 7 while placing the process cartridge 7 in the development spacing state by a cam portion (slope-shaped portion) 28*f* of the slider guide 28, so that the user has to pull out the process cartridge 7 with a large force and therefore an operating force becomes large and usability is impaired.

Further, in this embodiment, a grip portion 101*a* ((a) of FIG. 1) of the access door 101 is provided at an upper portion of the apparatus, so that a large radius ratio about the shaft 61 is ensured relative to an outer configuration of the spacing cam 62 while interrelating with the interrelating lever 60 ((b) of FIG. 1). Further, as shown in (a) and (c) of FIG. 12, when the first cam 80 is in the spaced phase and the movable unit is in the spaced position and is in the development spacing state, the spacing cam 62 does not urge and move the portion-to-be-urged 35*e* of the slider 35. For this reason, a force does not act on the access door 101 in the closed state.

Thus, in this embodiment, the operating force of the access door 101 is suppressed to a low level and also deformation such as creepage is prevented, and an outer appearance of a cover of the apparatus can be satisfactorily maintained. Incidentally, if the movement amount is a second movement amount smaller than the first movement amount (distance L) when the first cam 80 is in the spaced phase and the movable unit is in the spaced position and in the development spacing state, the spacing cam 62 may also urge and move the portion-to-be-urged 35*e* of the slider 35.

Thus, when the second movement amount is smaller than the first movement amount, compared with the case where the access door 101 is opened in the development contact state, an amount of work by the operating force for opening the access door 101 can be made small in the case where the access door 101 is opened in the development spacing state.

(Transition from Development Spacing to Development Contact)

In the above, the operations in the first and second modes from the development contact to the development spacing were described, but on the other hand, transition from the development spacing to the development contact is as follows. That is, the first cam 80 is rotated using the contact-and-separation means (Embodiments 5-7) by rotation of the motor 90 for driving the contact-and-separation means. In this case, as the link mechanism in the horizontal plane, rotation of the lever 34, and the slider 35 perpendicular to the cam surface of the first cam 80 and the pressing spring 32 as the urging means for urging the developer carrying member against the image bearing member are used.

Further, by rotation of the movable member 31 rotated in interrelation with displacement of the slider 35, the rib 31*g* of the movable member 31 contacts the rib 4*e* of the developing unit 4 ((c) of FIG. 5). As a result, the transition from the development spacing to the development contact is made.

(Stand-by State, Color Print State, Monochromatic Print State)

Figure 8:
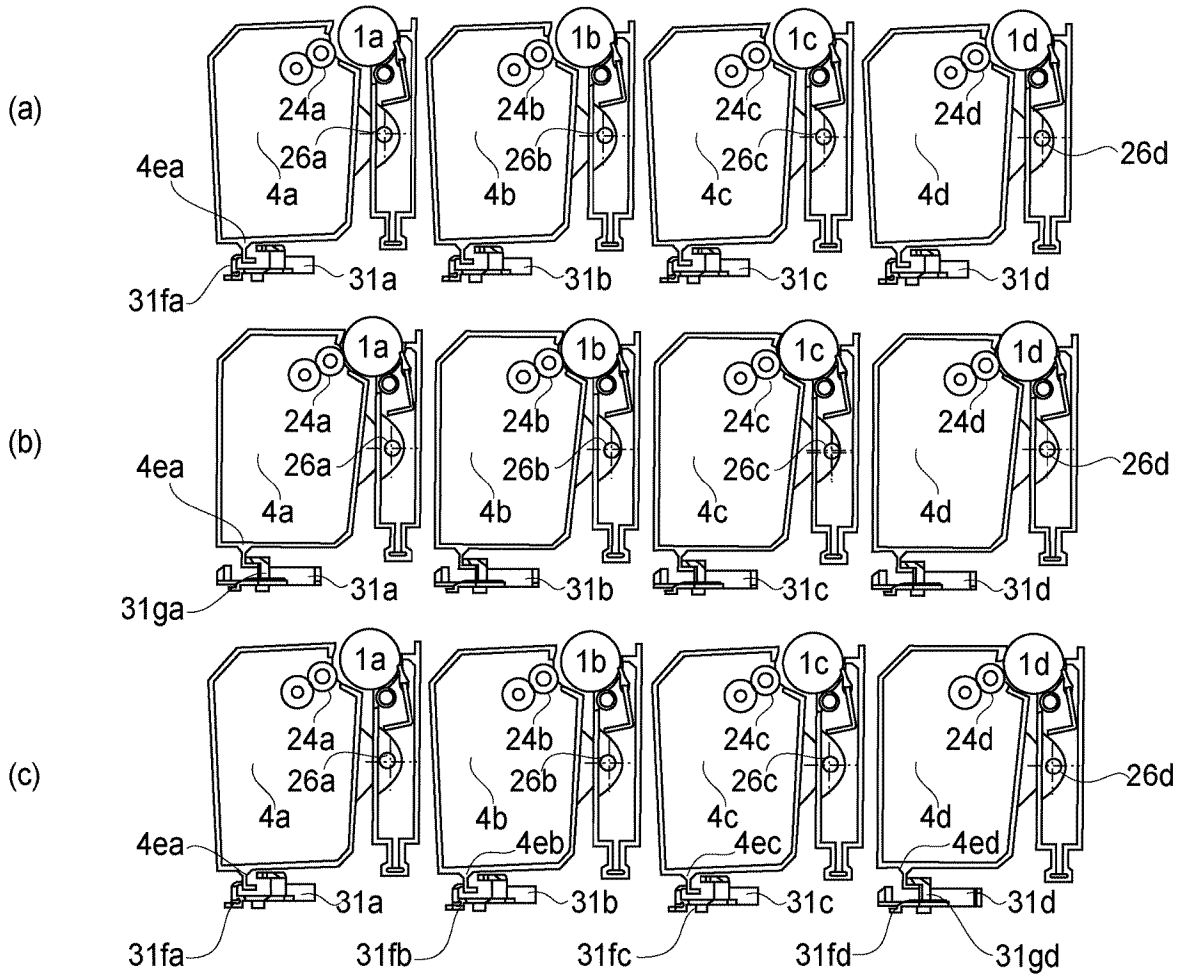
In FIG. 8, (a) is a schematic sectional view of the contact-and-separation means in an all-spaced state, (b) is a schematic sectional view of the contact-and-separation means in a color print state, and (c) is a schematic sectional view of the contact-and-separation means in a monochromatic print state, in the First Embodiment.

In FIG. 8, (a) to (c) are schematic sectional views for illustrating contact and spacing of the respective developing rollers 24 (24*a*-24*d*) by the four movable members 31 (31*a*-31*d*) of the contact-and-separation means, in which (a) shows an all-spaced state, (b) shows a color print state, and (c) shows a monochromatic print state.

The above-described four cams 80 (80*a*, 80*b*, 80*c*, 80*d*) are all the same-shaped cam and are disposed with phases different from each other although this will be described later. In the all-spaced state, as shown in (a) of FIG. 8, the ribs 31*f* (31*fa*-31*fd*) of the movable members 31 urge the ribs 4*e* (4*ea*-4*ed*) of the developing units 4 in a direction from the left side to the right side of the apparatus. Then, the stand-by state in which all of the developing rollers 24 (24*a*-24*d*) and the corresponding photosensitive drums 1 (1*a*-1*d*) are spaced from each other is formed. Incidentally, in (a) of FIG. 8, only a relationship between the rib 31*fa* and the rib 4*ea* is shown for convenience. In the color print state, as shown in (b) of FIG. 8, all of the ribs 31*g* (31*ga*-31*gd*) of the movable members 31 urge the ribs 4*e* (4*ea*-4*ed*) of the developing units 4 in a direction from the right side to the left side of the apparatus. Then, a state in which all of the developing rollers 24 (24*a*-24*d*) and the corresponding photosensitive drums 1 (1*a*-1*d*) are contactable with each other is formed. Incidentally, in (b) of FIG. 8, only a relationship between the rib 31*ga* and the rib 4*ea* is shown for convenience. In the monochromatic print state, in (c) of FIG. 8, the ribs 31*f* (31*fa*, 31*fb*, 31*fc*) of the movable members 31 corresponding to the three colors of yellow, magenta, and cyan urge the side surfaces of the corresponding ribs 4*e* (4*ea*, 4*eb*, 4*ec*) of the developing units 4 in a direction from the left side to the right side of the apparatus. For this reason, a state in which the developing rollers 24 (24*a*, 24*b*, 24*c*) corresponding to yellow, magenta, cyan and the corresponding photosensitive drums 1 (1*a*, 1*b*, 1*c*) are spaced from each other is formed. On the other hand, only the rib 31*gd* of the movable member 31 corresponding to black urges the side surface of the rib 4*ed* of the developing unit 4 from the right side to the left side of the apparatus, so that a state in which only the developing roller 24*d* corresponding to black contacts the photosensitive drum 1*d* is formed.

(Switching Among Stand-by State, Color Print State and Monochromatic Print State)

Thus, switching among the stand-by state, the color print state and the monochromatic print state is made by rotating the respective first cams 80 by rotationally driving the motor 90 and then by controlling the rotational phases of the first cams 80. At this time, there is a need that the motor 90 is stopped at a desired position, but control of a rotation amount of the motor 90 is effected using the photo-interruptor 49 in the following manner.

That is, (b) of FIG. 5 is a perspective view of a cam gear 94*d* as seen from above the apparatus in the rear side, and the cam gear 94*d* rotated integrally with the cam 80*d* contacting the developing unit 4*d* for black is provided with a rib 94*e*. The rib 94*e* is rotated by rotation of the cam gear 94*d*, and when the cam gear 94*d* and the cam 80*d* are in a predetermined rotational phase, light is blocked. Accordingly, on the basis of an output signal of the photo-interruptor 49, it is possible to detect the rotational phase of the cam 80*d* rotating together with the cam gear 94*d*.

Then, a position where the photo-interruptor 49 is in a light-blocking state is a reference position, and from the reference position, the number of driving steps of the motor 90 which is the stepping motor is associated with the rotational phase of the image cam 80. As a result, by counting the number of the driving steps, the rotational phase (rotation amount) of the first cam 80 is acquired, so that the motor 90 can be stopped in the stand-by state, the color print state and the monochromatic print state which are described above. Incidentally, the cam gear 94 and the cam 80 are mounted coaxially by the shaft 95.

In this embodiment, the rib 94*e* is provided on the cam gear 94*d* for K, but is not limited thereto. The rib 94*e* may also be provided on other cams 94*a*, 94*b*, 94*c* for Y, M, C.

In this embodiment, the rotational phase detection of the cam gear 94 is carried out by the photo-interruptor 49 and the rib 94*e*, but may also be carried out by a rotary encoder or another known method. Further, as the motor 90, the stepping motor is used, but the motor 90 is not limited thereto. That is, when the first cam 80 can be stopped at a predetermined rotational phase (stand-by state, color print state, monochromatic print state), as the driving source, a DC brush motor, a DC brush-less motor or the like may also be used.

(Transition from Stand-by State to Color Print State)

Transition from the stand-by state of (a) of FIG. 8 to the contact state during color printing (color print state) of (b) of FIG. 8 will be described. Switching between these states is carried out in timing with a start of the toner image formation on the photosensitive drum 1 so as to be in time for the start of the toner image formation.

As described above, the four first cams 80 (80*a*-80*d*) have the same-shaped cam surface. Further, in FIG. 5, the first cams 80*b*, 80*c*, 80*d* are out of phase from the first cam 80*a* as a reference with respect to the counterclockwise direction, and a deviation amount of the rotational phase increases in the order of the cam 80*b*, the cam 80*c* and the cam 80*d*.

In the stand-by state of (a) of FIG. 8 when the motor 90 is rotated in a normal (forward) direction by a predetermined step, the respective cam gears 94 and the respective cams 80 are rotated in the counterclockwise direction (normal direction). At this time, due to the above-described deviation in phase among the first cams 80, first, the cam 80*a* moves the slider 35*a*, so that the movable means 31*a* urges the side surface of the rib 4*ea* of the developing unit 4. Then, in accordance with the above-described rotational phase deviation, the cams 80*b*, 80*c*, 80*d* urge the associated developing units 4 in the named order.

That is, when the motor 90 is rotated from the stand-by state of (a) of FIG. 8 in the normal direction, the developing rollers 24 are contacted to the photosensitive drums 1 in the order of those for yellow, magenta, cyan and black. Then, image formation is started from the image forming station where the contact of the developing roller 24 is completed, and the toner images are successively formed on the photosensitive drums 1 and are successively transferred onto the intermediary transfer belt 12*e*. Incidentally, when the motor 90 is rotated in the normal direction by a predetermined step and contact of all of the developing rollers 24 is completed, the transition to the contact state during color printing shown in (b) of FIG. 8 is completed.

Incidentally, the developing roller 24*a* first moving to the contact position is a first developing member, and other developing rollers 24*b*-24*d* are second developing members. Similarly, the photosensitive drum 1*a* first starting the image formation is a first photosensitive member, and other photosensitive drums 1*b*-1*d* are second photosensitive members.

Here, the reason why timings of the start and the completion of the contact of the respective developing rollers 24 are sequentially deviated with a time will be described. This is because the developing roller 24 is spaced from the photosensitive drum 1 to the extent possible until immediately before the image formation is started, while starting the image formation in timing with the transfer of the toner images from the photosensitive drums 1 onto the intermediary transfer belt 12*e* at the respective image forming stations. That is, timings of the start and the completion of the contact of the developing rollers 24 are deviated by times equal to times required for respective predetermined points of the surface of the intermediary transfer belt 12*e* to move between associated primary transfer positions of the associated photosensitive drums 1.

(Transition from Color Print State to Stand-by State)

Transition from the color print state to the stand-by state is made in synchronism with the end of the toner image formation, and the motor 90 is normally rotated by the predetermined step. As a result, the developing rollers 24 are spaced from the photosensitive drums 1 in the order starting from the image forming station where the image formation is first ended. That is, in the order of yellow, magenta, cyan and black, the developing rollers 24 are spaced (retracted) from the photosensitive drums 1 and go to the stand-by state.

(Transition from Stand-by State to Monochromatic Print State)

Transition from the stand-by state of (a) of FIG. 8 to the contact state (monochromatic print state) during monochromatic printing of (c) of FIG. 8 will be described. Switching of these states is made in timing with the start of the toner image formation on the photosensitive drum 1 so as to be in time for the start of the toner image formation. In the stand-by state of (a) of FIG. 8, the motor 9 is reversely rotated by a predetermined step. Then, the respective cam gears 94 and the respective cams 80 are rotated in the counterclockwise direction, but in the case of the reverse rotation, due to the above-described deviation in rotational phase of the cam 80, first, only the movable member 31*fd* urges (presses) the rib 4*ed* of the developing unit 4.

As a result, only the developing roller 24*d* contacts the photosensitive drum 1*d*. The number of the predetermined step is set so that the drive of the motor 90 is stopped in this state, so that only the developing roller 24*d* is maintained in the contact state with the photosensitive drum 1 during the monochromatic printing of (c) of FIG. 8.

(Transition from Monochromatic Print State to Stand-by State)

Transition from the monochromatic print state to the stand-by state is made by normally rotating the motor 90 by a predetermined step. As a result, the movable member 31*fd* urges the rib 4*ed* of the developing unit 4, so that the developing roller 24*d* is spaced from the photosensitive drum 1 and is returned to the stand-by state.

As described above, by controlling the direction (normal rotation, reverse rotation) and the rotation amount of the rotational drive of the motor 90, the contact and spacing (separation) between the respective developing rollers 24 and the associated photosensitive drums 1 can be controlled to three states consisting of the stand-by state, the color print state and the monochromatic print state.

(Comparison with Conventional Example)

Figure 9:
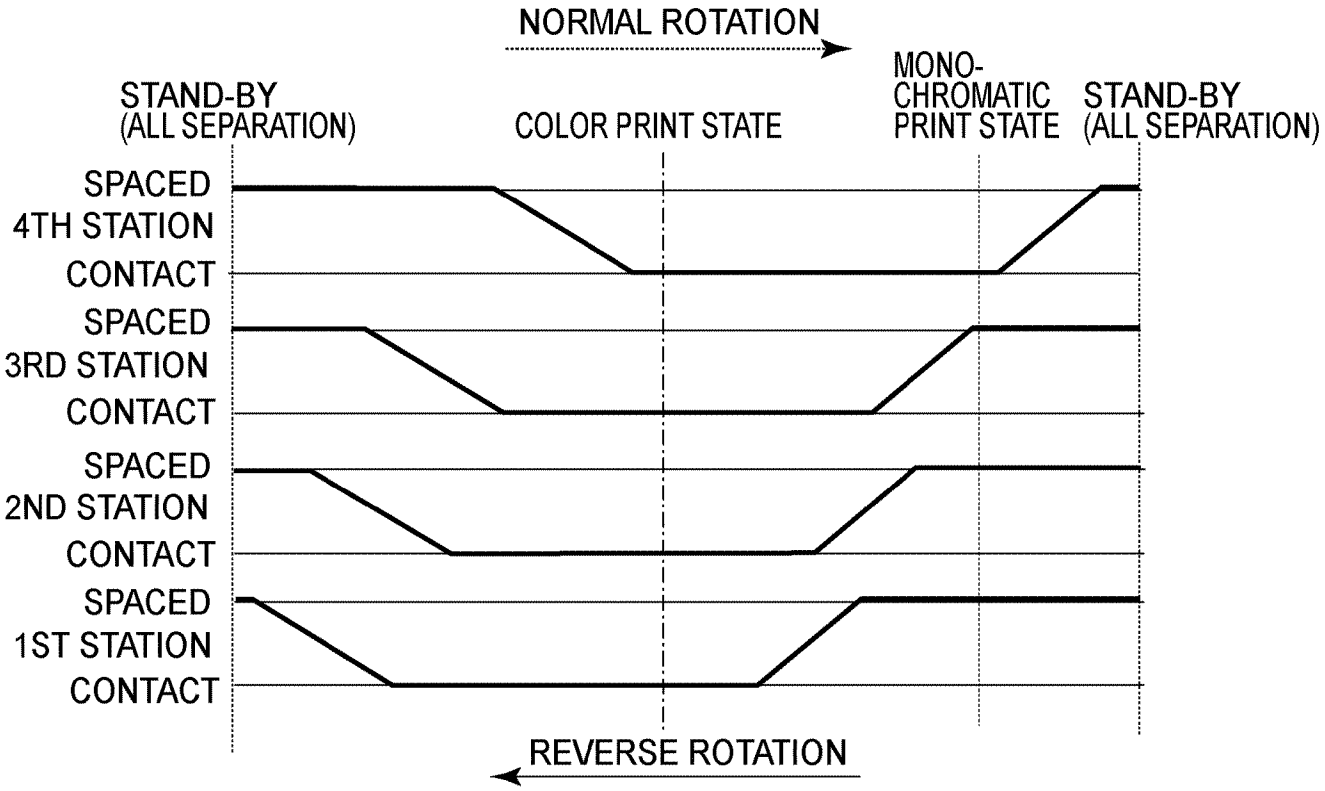
FIG. 9 is a schematic view showing a relationship between rotation of the cam gear (cam) rotated by a contact-and-separation motor and contact and spacing (separation) of respective developing rollers in contact and spacing (separation) control in the First Embodiment.

FIG. 9 is a schematic view showing a relationship between the rotation of the cam gear 94 (cam 80) rotated by the motor 90 and the contact and spacing of the respective developing rollers 24. The abscissa represents a time interval corresponding to one full turn (circumference) of the cam gear 94, and in the case where the motor 90 is normally rotated (in the case where the cam 80 is rotated in the counterclockwise direction), the state changes from the left side toward the right side in the figure. In the case where the motor 90 is reversely rotated (in the case where the cam 80 is rotated in the clockwise direction), the state changes from the right side toward the left side in the figure. When the cam 80 is rotated in one direction by one full turn, the state is the same as the state before the rotation, and therefore the stand-by state at a leftmost end and the stand-by state at a rightmost end in the figure are the same state.

In the following, a constitution including a pair of the developing roller 24 and the photosensitive drum 1 for each of the respective colors of the toners is defined as the image forming station, and the image forming station where the image formation is effected using a yellow toner is defined as an image forming apparatus 1 (1ST STATION (1st)). Similarly, the image forming apparatus where the image formation is effected using a magenta toner is defined as an image forming apparatus 2 (2ND STATION (2st)), and the image forming apparatus where the image formation is effected using a cyan toner is defined as an image forming apparatus 3 (3RD STATION (3st)). Further, the image forming apparatus where the image formation is effected using a black toner is defined as an image forming apparatus 4 (4TH STATION (4st).

When the state shifts from the stand-by state to a full-color state (color print state), as described above, the rotational phases of the cams 80*a*-80*d* are provided so as to be deviated from each other. For that reason, as shown in FIG. 9, the respective developing rollers 24 are moved toward the corresponding photosensitive drums 1 and are contacted to the photosensitive drums 1 in the order of yellow (1st), magenta (2st), cyan (3st) and black (4st). The rotation of the motor 90 is stopped after the contact of the final developing roller 24*d* with the photosensitive drum 1*d* is completed by the above-described control of the rotation amount.

Second Embodiment

The Second Embodiment of the present invention will be described. Incidentally, a general structure of an image forming apparatus and a contact-and-separation means excluding a constitution of a first cam 80 are similar to those in the First Embodiment and therefore are represented by the same reference numerals or symbols and will be omitted from description. In the First Embodiment, for each of the process cartridges 7, a constitution in which the developing roller 24 is contacted and urged to the photosensitive drum 1 and is spaced from the photosensitive drum 1 by the movable member 31 and the urging member 32 which are provided in the apparatus main assembly side was employed.

On the other hand, in this embodiment, the process cartridge 7 itself includes an urging member, and the developing roller 24 is contacted and urged to the photosensitive drum 1. Further, a development spacing operation with the movable member 31 by the motor 90 and development spacing by the opening operation of the front door 101 are carried out.

Figure 13:
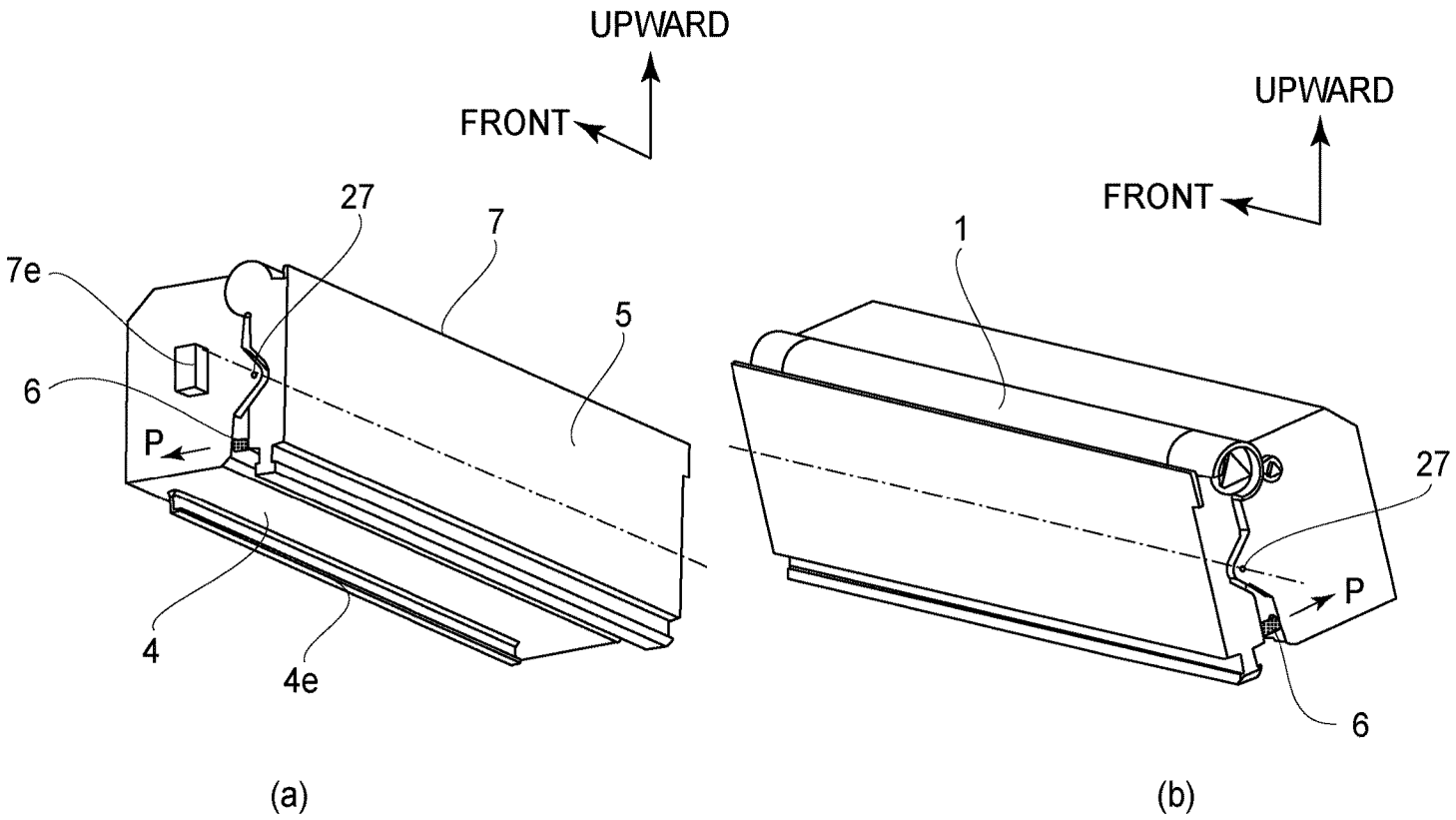
In FIG. 13, (a) and (b) are schematic perspective views of a process cartridge in an image forming apparatus in a Second Embodiment.

In FIG. 13, (a) and (b) are perspective views showing the process cartridge 7 in which the process cartridge 7 itself includes the urging member 6 (compression spring), in which (a) is the perspective view of the process cartridge 7 in which the urging member 6 is provided at a front end thereof with respect to the front-rear direction of the apparatus, and (b) is the perspective view of the process cartridge 7 in which the urging member 6 is provided at a rear end thereof with respect to the front-rear direction of the apparatus. By these urging members 6, the developing roller 24 is contacted to and urged against the photosensitive drum 1 by the process cartridge 7 itself.

Figure 14:
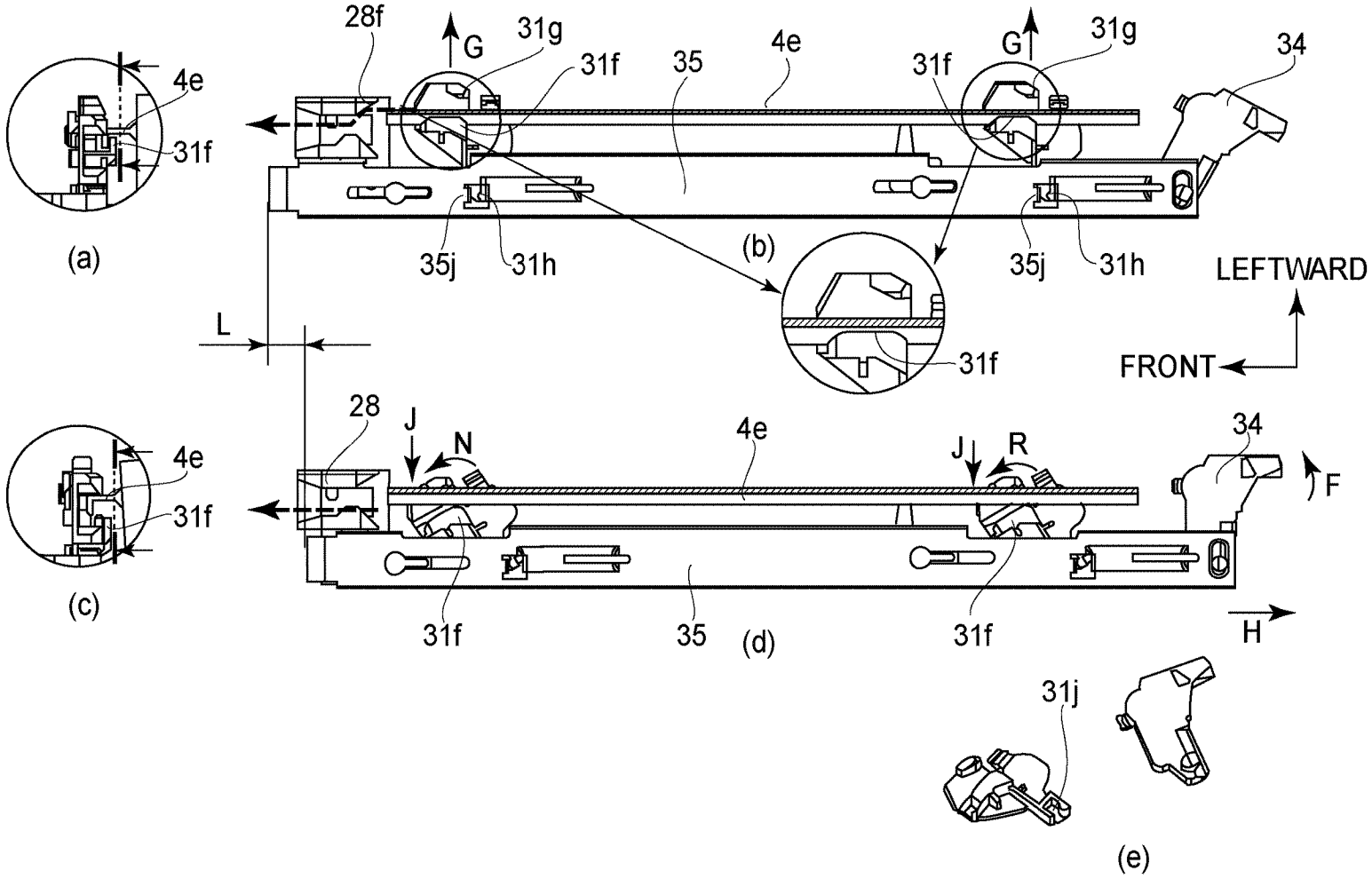
In FIG. 14, (a) is a partly enlarged view of a development contact-and-separation means during development contact in a front side of the image forming apparatus, (b) is a schematic view of the development contact-and-separation means during development contact as seen from an upper portion of the image forming apparatus, (c) is a partly enlarged view of the development contact-and-separation means during development spacing in the front side of the image forming apparatus, (d) is a schematic view of the development contact-and-separation means during development spacing as seen from the upper portion of the image forming apparatus, and (e) is a partly enlarged view of the development contact-and-separation means in a rear side of the image forming apparatus as seen from a lower portion of the image forming apparatus, in the Second Embodiment.

In FIG. 14, (a) to (e) are schematic views showing the horizontal plane similar to that in FIG. 7 and show a relationship between the development spacing means and the rib 4*e* of the developing unit 4 as seen from above the apparatus. In FIG. 14, (a) is a partly enlarged view as seen from the front side during development contact, (b) is a partial sectional view of (a) of FIG. 14. In FIGS. 14, (c) and (d) are a partly enlarged view and a partial sectional view which correspond to (a) and (b) of FIG. 14, respectively, during development spacing.

During development contact, the ribs 31*f* of the movable members 31 urge the ribs 4*e* at two positions, with respect to the front-rear direction of the apparatus, by an elastic force of the urging members 6 (as shown by arrows P in (a) and (b) of FIG. 13) in the process cartridge 7. As a result, the developing roller 24 contacts the photosensitive drum 1. At this time, a clearance is provided so that the ribs 31*f* of the movable means do not urge the ribs 4*e* of the process cartridge 7 (partly enlarged view of (b) of FIG. 14).

When the transition from the development contact to the development spacing is made, with an increase in cam diameter of the first cam 80, the lever 34 is first swung as shown by an arrow F in (d) of FIG. 14, and then the slider 35 is linearly moved in the direction from the front side toward the rear side of the apparatus as indicated by an arrow H. The slider 35 is provided with two bent portions 35*j*, so that the slider 35 can contact the rib 31*f*, and therefore when the slider 35 moves in a certain amount or more, the movable member 31 starts rotation by the slider 35 as shown by an arrow R in the figure. Then, the ribs 31*g* of the movable members 31 move the ribs 4*e* in the direction from the left side toward the right side of the apparatus (arrow J direction of (d) of FIG. 14).

By employing such a constitution, in accordance with the rotation of the first cam 80, the lever 34 is rotated, so that the slider 35 moves from the front side toward the rear side of the apparatus by L. Thus, similarly as in FIG. 7 in the First Embodiment, the state can be changed from the development contact state to the development spacing state.

Thus, the development spacing is made by the access door 101, so that there is no need that the user pulls out the process cartridge 7 in the development contact state with a large operating force. That is, as shown by a broken line arrow in (b) of FIG. 14, there is no need that the user pulls out the process cartridge 7 in the apparatus front surface direction while forming the development spacing state by the cam portion 28*f* (slope-shaped portion) of the slider guide 28, so that usability can be satisfactorily maintained.

In this embodiment, compared with the First Embodiment in which the urging means for the process cartridge 7 during development contact in the apparatus main assembly is provided in the main assembly side, a constitution in which the urging members 6 are provided in the process cartridge 7 and thus the process cartridge 7 itself is provided with the urging means during development contact is employed. Also in the image forming apparatus employing the above-described constitution, an operating force of the process cartridge can be reduced.

Third Embodiment

The Third Embodiment of the present invention will be described. Also in this embodiment, a general structure of an image forming apparatus and a contact-and-separation means excluding a constitution of a first cam 80 are similar to those in the First Embodiment and therefore are represented by the same reference numerals or symbols and will be omitted from description. In the First Embodiment, for each of the process cartridges 7 of an integral type, a constitution in which the developing roller 24 is contacted and urged to the photosensitive drum 1 and is spaced from the photosensitive drum 1 by the movable member 31 and the urging member 32 which are provided in the apparatus main assembly side was employed.

On the other hand, in this embodiment, the process cartridge 7 is constituted by two members consisting of the developing unit 4 and the cleaner unit 5, in which the developing roller 24 is contacted to and urged against the photosensitive drum 1. In this image forming apparatus, the development spacing is carried out by the opening operation of the front door (access door) 101.

In the market, depending on the contents of printing by the user, the case where the toner is consumed early and the case where the photosensitive drum is consumed early exist in some instances. For this reason, the process cartridge 7 is provided in the two members, so that the developing unit and the cleaning unit can be individually exchanged, and reduction in print cost and resource saving from the viewpoint of the user can be realized.

Figure 15:
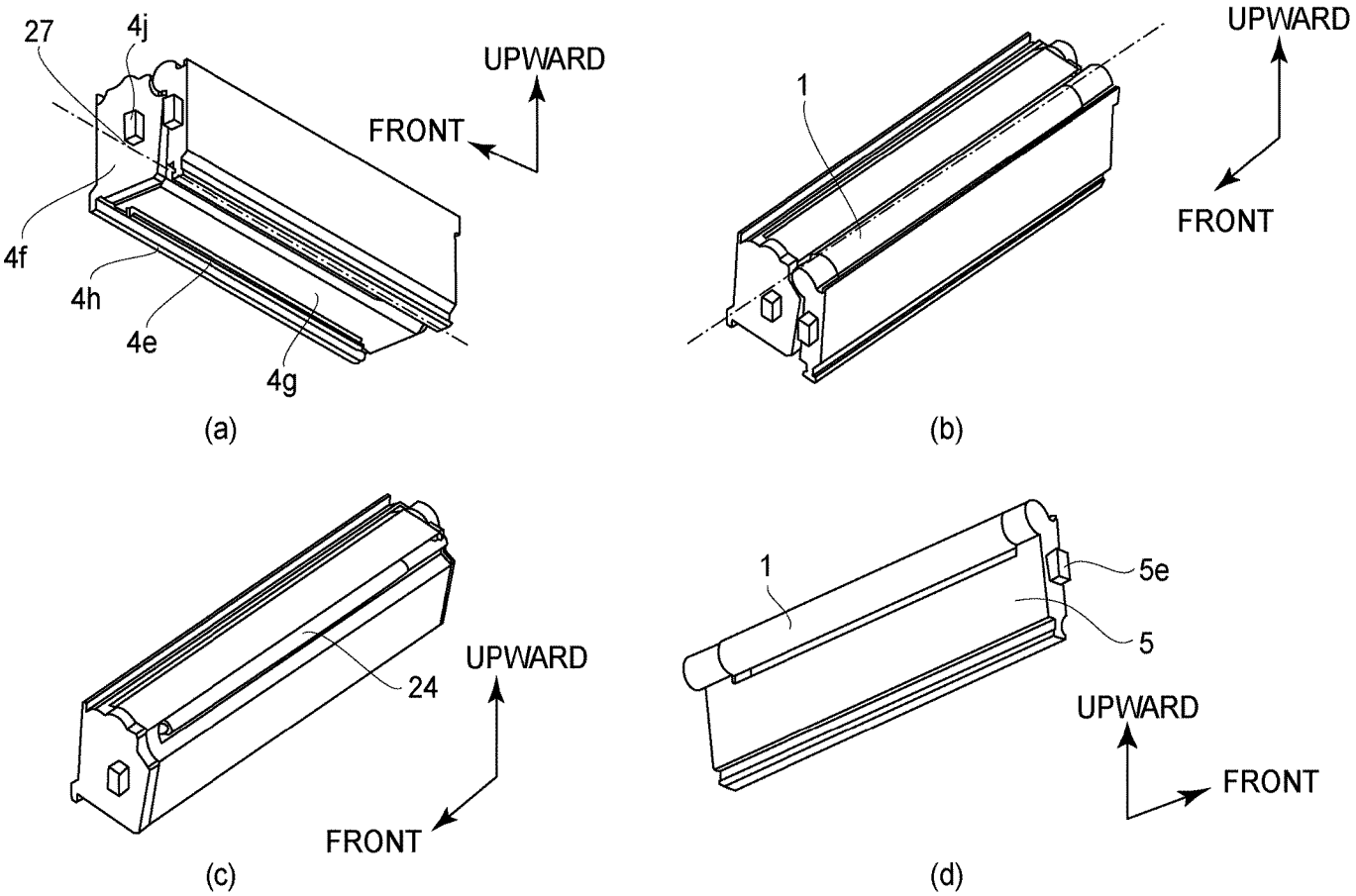
In FIG. 15, (a) to (d) are schematic perspective views of a process cartridge in an image forming apparatus in a Third Embodiment.

In FIG. 15, (a) to (d) are perspective views of the process cartridge provided in the two members consisting of the developing unit 4 and the cleaner unit 5. In FIG. 15, (a) and (b) show a state in which the developing unit 4 and the cleaner unit 5 act on each other for image formation as during the image formation. In FIG. 15, (c) is the perspective view of the developing unit 4, and (d) is the perspective view of the cleaner unit 5. The developing unit 4 is roughly constituted by a developing frame 4*f* and a developing container 4*g* which use a pin 27 as a swing center, so that the developing container 4*g* is swung relative to the developing frame 4*f*.

The device 4 and the cleaner unit 5 are provided with a grip portions 4*j* and 5*e*, respectively. The developing unit 4 and the cleaner unit 5 are independently (individually) detachably mountable to the apparatus main assembly. That is, in either of a state in which the cleaner unit 5 is mounted in the apparatus main assembly and a state in which the cleaner unit 5 is demounted from the apparatus main assembly, the developing unit 4 is detachably mountable to the apparatus main assembly. On the other hand, in either of a state in which the developing unit 4 is mounted in the apparatus main assembly and a state in which the developing unit 4 is demounted from the apparatus main assembly, the cleaner unit 5 is detachably mountable to the apparatus main assembly.

Figure 16:
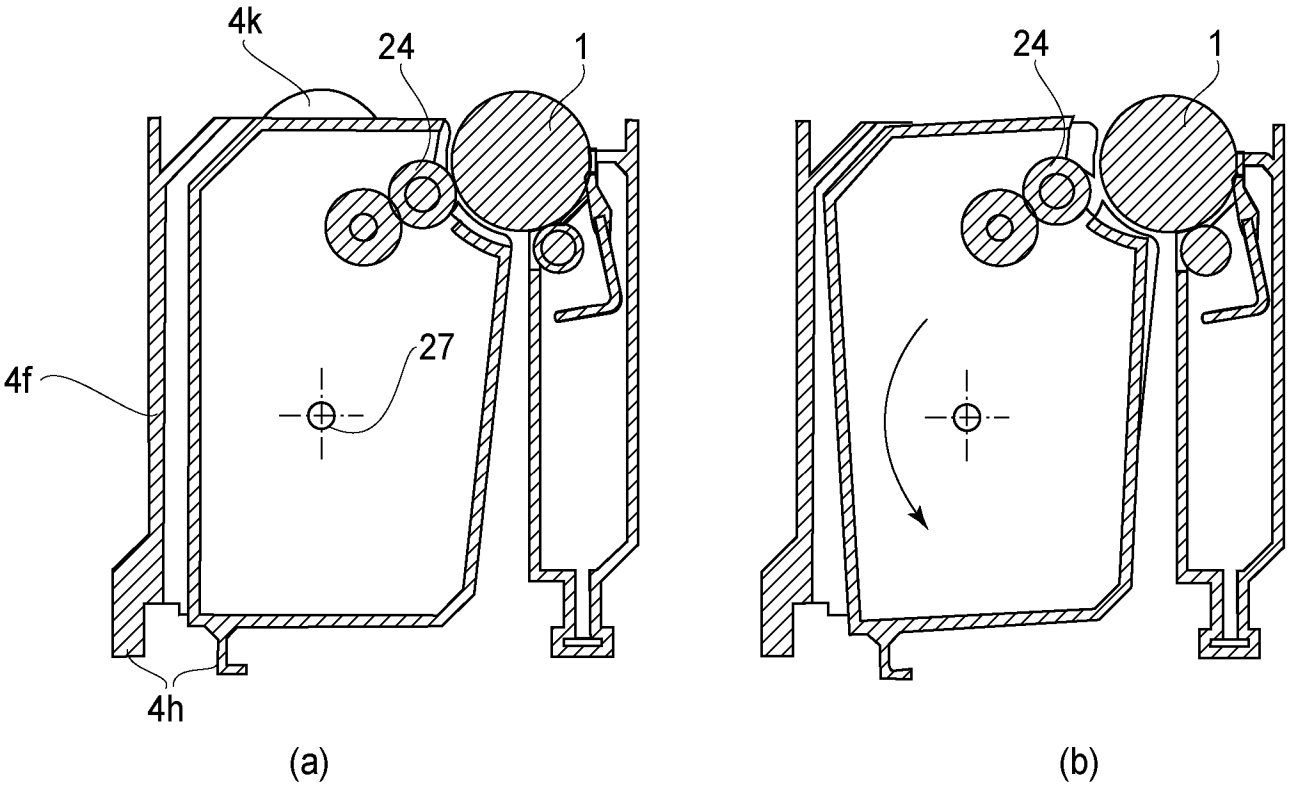
In FIG. 16, (a) is a schematic sectional view of a part of a contact-and-separation means during development contact, and (b) is a schematic sectional view of a part of the contact-and-separation means during development spacing, in the Third Embodiment.

In FIG. 16, (a) and (b) are schematic sectional views of the process cartridge in this embodiment, in which (a) shows a state of the process cartridge during development contact, and (b) shows a state of the process cartridge during development spacing. Similarly as in (c) and (d) of FIG. 5 in the First Embodiment, about the pin 27, the ribs 4*h* are moved by an unshown movable means, so that during development spacing is realized. In this embodiment, as shown in FIG. 6 in the First Embodiment, the urging means for the process cartridge 7 during development contact in the apparatus main assembly is provided in the main assembly side.

Figure 17:
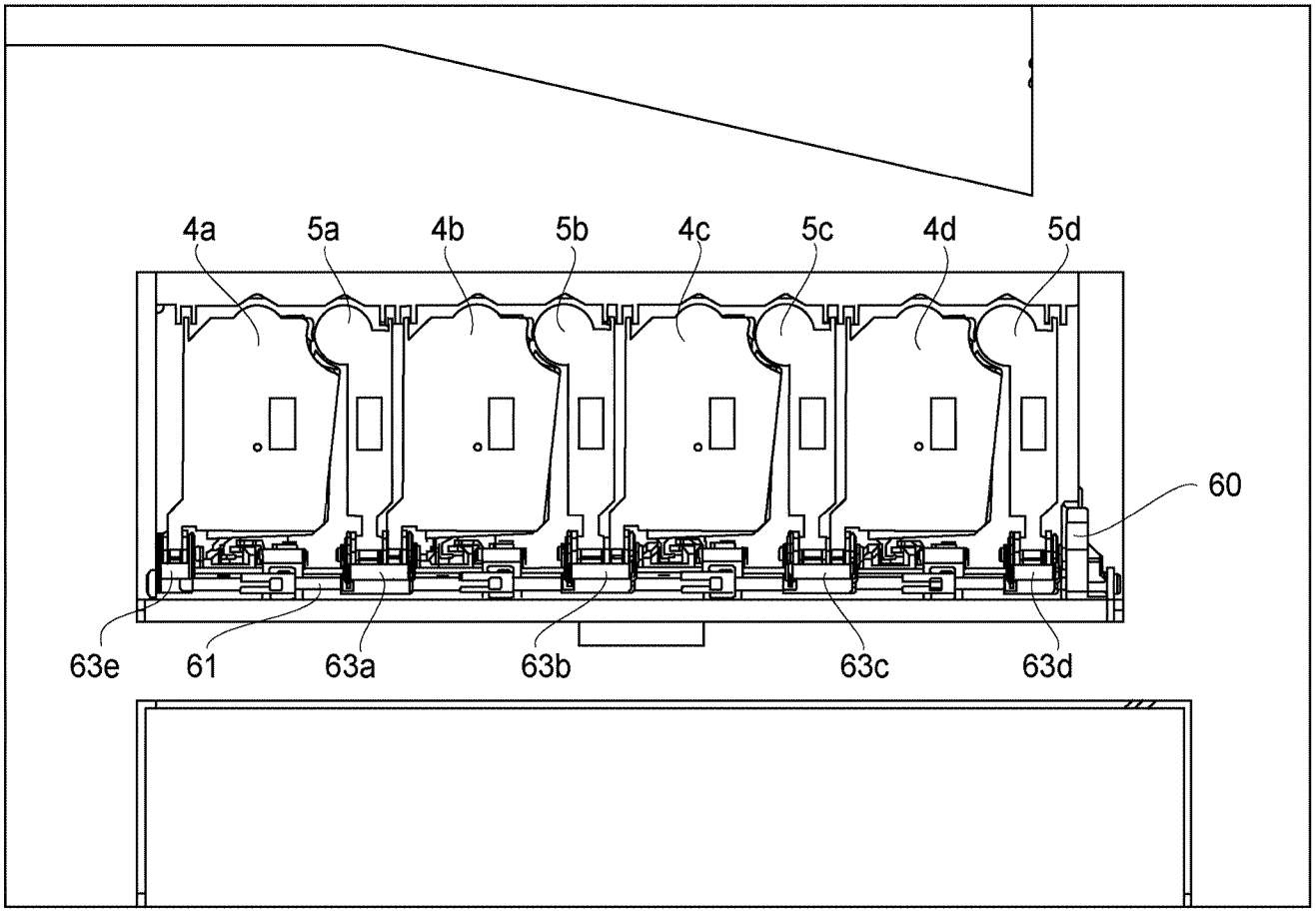
FIG. 17 is a front view of the image forming apparatus in the Third Embodiment when an access door is opened.

FIG. 17 is a schematic view of an image forming apparatus in which developing units 4*a*, 4*b*, 4*c*, 4*d* corresponding to respective colors of yellow (Y), magenta (M), cyan (C), black (K) and cleaner units 5*a*, 5*b*, 5*c*, 5*d* are provided in the apparatus main assembly. As regards the guide rails 63 of the process cartridges, these guide rails corresponding to those for the above-described process cartridges provided in the two members, and therefore the developing unit 4*a* for yellow (Y) is provided with an exclusive rail 63*e*. As regards the developing units 4*b*, 4*c*, 4*d* for magenta (M), cyan (C), black (K), respectively, the guide rails are provided so as to be disposed in integral and parallel with adjacent rails for left-side cleaner units 5 with respect to the left-right direction of the apparatus.

Figure 18:
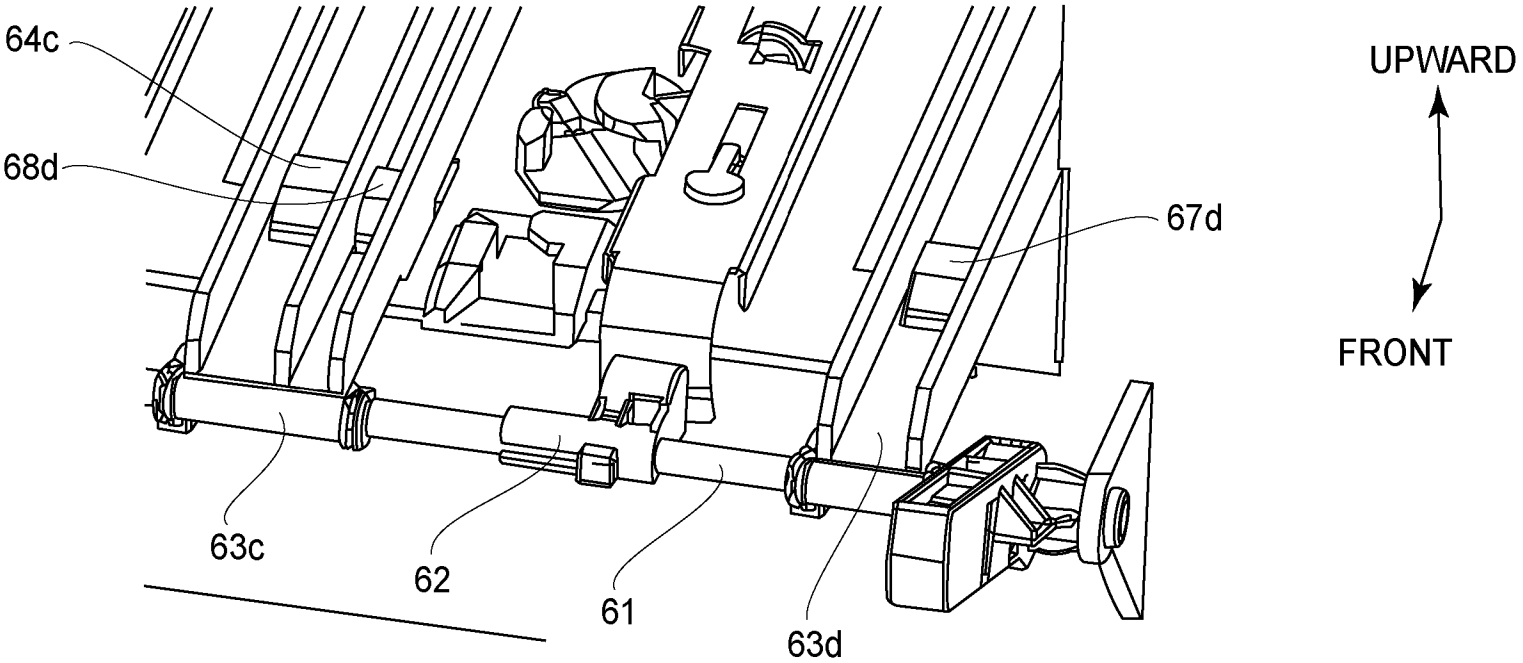

FIG. 18 is a perspective view showing a constitution including the guide rails 63*c*, 63*d* for cyan (C), black (K), respectively, and the shaft 61. As described above, as regards the developing unit 4, a movable member 68*d* for urging the rib 4*h* of the developing frame 4*f* is provided to the guide rail 63*c*. The movable member 68*d* is urged upward by an urging member (compression spring) in the apparatus similarly as in the case of the movable means 64 for the cleaner unit 5 ((a) and (b) of FIG. 12).

Figure 19:
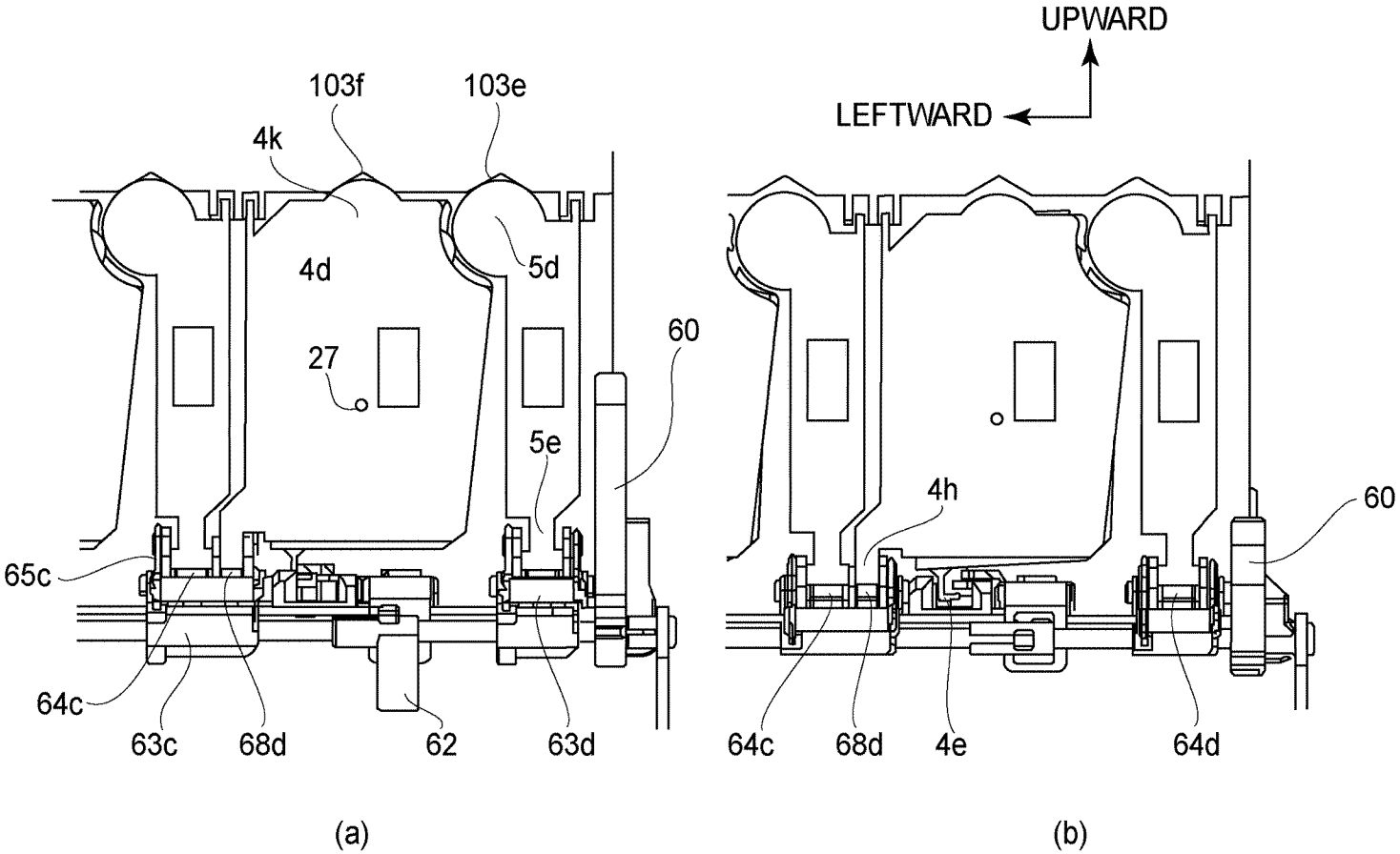
In FIG. 19, (a) and (b) are partly enlarged views, as seen from a front side of the image forming apparatus, for illustrating an opening and closing operation and a positional relationship among a process cartridge, the guide rail and the spacing cam, in the Third Embodiment.

In FIG. 19, (a) and (b) are partly enlarged views similar to those in FIG. 11, in which (a) shows a closed state of the access door 101 as seen from the front side of the K station, and (b) shows an open state of the access door 101 as seen from the front side of the K station. A lower portion 5*e* of the cleaner unit 5 has a substantially T-shape and engages with the guide rail 63 having a substantially U-shape in cross-section. An upper portion of the cleaner unit 5 has an arcuate shape positioned at a V-shaped portion 103*e* of an upper frame.

Urging against the V-shaped portion 103*e* is made by the movable member 64 provided in the guide rail 63, and in the closed state of the access door 101, the process cartridge 7 is urged upward in the apparatus. Also as regards the developing unit 4, the rib 4*h* of the developing frame 4*f* is engaged in a substantially U-shaped groove of the guide rail 63*c*, and an upper arcuate portion 4*k* of the developing frame 4*f* is positioned to a V-shaped portion 103*f* of the upper frame.

In the open state of the access door 101, urging of the process cartridge toward the V-shaped portions 103*e*, 103*f* is released (eliminated). For this reason, similarly as in the process cartridge of the integral type in the First Embodiment, the process cartridge can be pulled out from the apparatus main assembly in the development spacing state while suppressing the operating force to a low level.

Modified Embodiments

In the above-described embodiments, preferred embodiments of the present invention were described, but the present invention is not limited thereto and can be variously modified within the scope of the present invention.

Modified Embodiment 1

In the above-described embodiments, the movable member for moving the developing roller 24 including the first cam 80, the shaft 95 and the like was moved by being rotated by the motor 90 as the driving source, but the present invention is not limited thereto. That is, when a constitution in which the movable member is driven by a single actuator and a plurality of developing roller 24 are moved is employed, operations of the movable member and the actuator are not necessarily required to be performed by rotation.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-048367 filed on Mar. 11, 2016, which is hereby incorporated by reference herein in its entirety.

What is claimed is:

1. An image forming apparatus comprising:

a movable unit including a regulating portion for regulating a position of a developing unit for supporting a developer carrying member and movable between a contact position for permitting contact of said developer carrying member with an image bearing member and a spaced position for permitting spacing of said developer carrying member from said image bearing member;

a driving member for moving said movable unit from the contact position to the spaced position, said driving member being displaceable between a contact phase for permitting location of said movable unit at the contact position and a spaced phase for maintaining said movable unit at the spaced position;

an openable member for opening and closing an opening provided for demounting said developer carrying member and/or said image bearing member from a main assembly of said image forming apparatus; and a pressing member for pressing and moving said movable unit by being moved in interrelation with an opening operation of said openable member, wherein when said driving member is displaced from the contact phase to the spaced phase, said movable unit is moved by a first movement amount from the contact position to a first spaced position, and wherein when said openable member is opened, said pressing member presses and moves said movable unit to a second spaced position from the contact position by the first movement amount and a second movement amount smaller than the first movement amount.

2. An image forming apparatus according to claim 1, further comprising urging means for urging said movable unit in a direction in which said movable unit is moved from the spaced position to the contact position.

3. An image forming apparatus according to claim 2, further comprising second urging means for integrally urging said image bearing member and said developer carrying member upwardly.

4. An image forming apparatus according to claim 1, wherein said image bearing member and said developer carrying member are integrally detachably mountable to the main assembly of said image forming apparatus.

5. An image forming apparatus according to claim 1, wherein said image bearing member and said developer carrying member are independently detachably mountable to the main assembly of said image forming apparatus.

6. An image forming apparatus according to claim 1, wherein said driving member includes a rotatable motor and a cam rotated by said driving member, and wherein said movable unit includes a first rotating member contactable with and pressed by said cam, a slider connected with said first rotating member, and a second rotating member including said regulating portion and connected with said slider, wherein said slider includes a pressed portion pressed by said pressing member.

7. An image forming apparatus according to claim 6, wherein said slider is slidable in a slide direction along a longitudinal direction of said developer carrying member.

8. An image forming apparatus according to claim 7, wherein said movable unit includes two second rotating members.

9. An image forming apparatus according to claim 8, wherein said second rotating members are arranged in the slide direction.

10. An image forming apparatus according to claim 1, wherein when said openable member is opened in a state in which said driving member is in the contact phase, said pressing member presses and moves said movable unit by the first movement amount and the second movement amount from the contact position to the second spaced position.

11. An image forming apparatus according to claim 1, wherein when said openable member is opened in a state in which said driving member is in the spaced phase, said pressing member presses and moves said movable unit by the second movement amount from the first spaced position to the second spaced position.

* * * * *